US012523449B2

(12) United States Patent
Groat

(10) Patent No.: US 12,523,449 B2
(45) Date of Patent: Jan. 13, 2026

(54) PERSONAL PROTECTIVE VEST ASSEMBLY AND METHODS OF ASSEMBLING SAME

(71) Applicant: Safe Life Defense, LLC, Henderson, NV (US)

(72) Inventor: Nick Groat, Henderson, NV (US)

(73) Assignee: Safe Life Defense, LLC, Henderson, NV (US)

( * ) Notice: Subject to any disclaimer, the term of this patent is extended or adjusted under 35 U.S.C. 154(b) by 0 days.

(21) Appl. No.: 19/058,719

(22) Filed: Feb. 20, 2025

(65) Prior Publication Data

US 2025/0264305 A1 Aug. 21, 2025

Related U.S. Application Data

(60) Provisional application No. 63/556,311, filed on Feb. 21, 2024.

(51) Int. Cl.
*F41H 1/02* (2006.01)
*F41H 5/013* (2006.01)

(52) U.S. Cl.
CPC ..... *F41H 1/02* (2013.01)

(58) Field of Classification Search
CPC ..... F41H 1/02
See application file for complete search history.

(56) References Cited

U.S. PATENT DOCUMENTS 4,413,357 A * 11/1983 Sacks ..... F41H 1/02 2/2.5
4,578,821 A * 4/1986 Zufle ..... F41H 1/02 2/92
5,943,694 A * 8/1999 Moureaux ..... F41H 1/02 2/2.5
6,233,737 B1 * 5/2001 Ditchfield ..... F41H 1/02 2/2.5
6,276,255 B1 * 8/2001 Field ..... F41H 5/0485 2/2.5
7,424,748 B1 * 9/2008 McDunn ..... F41H 1/02 2/2.5
10,788,293 B2 * 9/2020 Beck ..... F41H 1/02
12,410,997 B2 * 9/2025 Groat ..... B29C 51/10
2009/0211000 A1 * 8/2009 Roux ..... F41H 1/02 2/2.5
2011/0061522 A1 * 3/2011 Jarrett ..... F41H 5/0485 89/36.02
2024/0310146 A1 * 9/2024 Groat ..... F41H 5/04

* cited by examiner

*Primary Examiner* — Robert H Muromoto, Jr.
(74) *Attorney, Agent, or Firm* — Howard & Howard Attorneys PLLC

(57) ABSTRACT

A personal protective vest assembly is described herein. The personal protective vest assembly includes a carrier vest including a front vest panel assembly adapted to overlay a chest of the wearer, a rear vest panel assembly adapted to overlay a back of the wearer, and a plurality of attachment straps removably coupled to the front vest panel assembly and the rear vest panel assembly. The front vest panel assembly includes a front vest panel body extending between a front vest upper portion and a front vest lower portion along a vertical axis and between opposing front vest side edges along a horizontal axis. The front vest panel body includes a forward facing outer surface including a pair of lower front vest fastening sections defined along the front vest lower portion orientated in a mirrored relationship along the vertical axis.

20 Claims, 29 Drawing Sheets

PERSONAL PROTECTIVE VEST ASSEMBLY AND METHODS OF ASSEMBLING SAME

CROSS REFERENCE TO RELATED APPLICATION

This application claims priority to U.S. Provisional Patent Application Ser. No. 63/556,311, filed Feb. 21, 2024, the disclosure of which is hereby incorporated by reference in its entirety.

FIELD OF THE INVENTION

This invention relates generally to personal protective vests including body armor panels.

BACKGROUND OF THE INVENTION

At least some known personal protective vests include rigid ballistic panels that are sown into the vest to provide the wearer protection from small arms fire. These rigid ballistic panels to not allow for a freedom of movement that is desired by security personal to provide additional comfort and flexibility, while providing a high level of safety protection.

The present invention addresses one or more of the aforementioned challenges.

SUMMARY OF THE INVENTION

In one aspect of the present invention, a personal protective vest assembly is provided. The personal protective vest assembly includes a carrier vest including a front vest panel assembly adapted to overlay a chest of the wearer, a rear vest panel assembly adapted to overlay a back of the wearer, and a plurality of attachment straps removably coupled to the front vest panel assembly and the rear vest panel assembly. The front vest panel assembly includes a front vest panel body extending between a front vest upper portion and a front vest lower portion along a vertical axis and between opposing front vest side edges along a horizontal axis. The front vest panel body includes a forward facing outer surface, an interior facing outer surface, and an inner surface defining a front vest ballistic panel pocket therein. The forward facing outer surface includes a pair of lower front vest fastening sections defined along the front vest lower portion orientated in a mirrored relationship along the vertical axis, with each lower front vest fastening section including hook & loop fabric material extending from a corresponding front vest side edge towards a center of the front vest lower portion and including an interior edge spaced a distance from the corresponding front vest side edge and having a concave arcuate shape extending from an upper end of the front vest lower portion to a bottom edge of the forward facing outer surface. A flexible body armor panel is positioned within the front vest ballistic panel pocket and including a ballistic material panel including a plurality of layered material segments defined between a strike face and a wear face, each of the layered material segments including a different ballistic material.

In another aspect of the present invention, a carrier vest is provided. The carrier vest includes a front vest panel assembly adapted to overlay a chest of the wearer, a rear vest panel assembly adapted to overlay a back of the wearer, and a plurality of attachment straps removably coupled to the front vest panel assembly and the rear vest panel assembly. The front vest panel assembly includes a front vest panel body extending between a front vest upper portion and a front vest lower portion along a vertical axis and between opposing front vest side edges along a horizontal axis. The front vest panel body includes a forward facing outer surface and an interior facing outer surface. The forward facing outer surface includes a pair of lower front vest fastening sections defined along the front vest lower portion orientated in a mirrored relationship along the vertical axis, with each lower front vest fastening section including hook & loop fabric material extending from a corresponding front vest side edge towards a center of the front vest lower portion and including an interior edge spaced a distance from the corresponding front vest side edge and having a concave arcuate shape extending from an upper end of the front vest lower portion to a bottom edge of the forward facing outer surface.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE INVENTION

Figure 1:
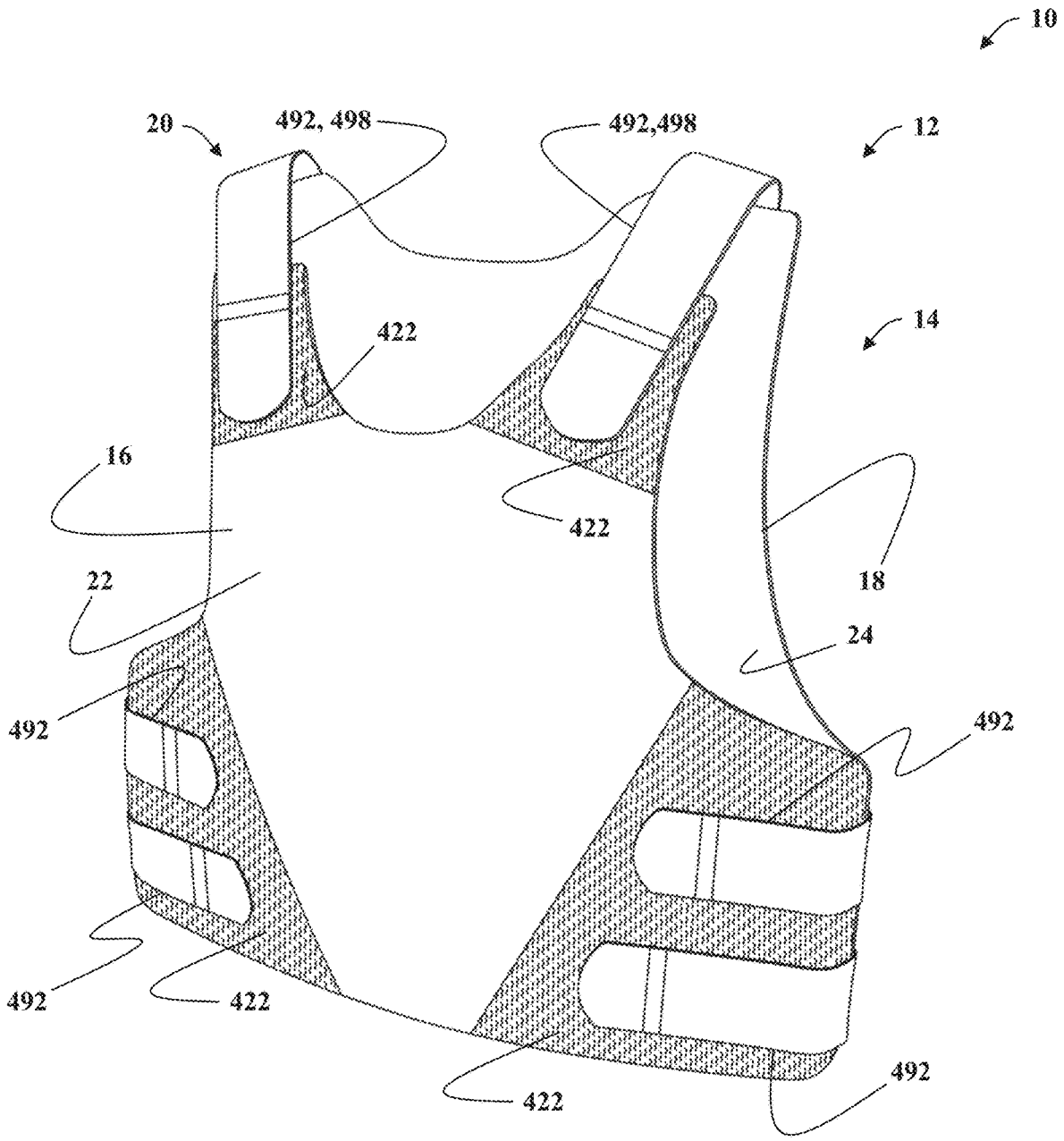
FIG. 1 is a perspective view of a personal protective vest assembly including a carrier vest and body armor panels, according to an embodiment of the present invention.
Figure 2:
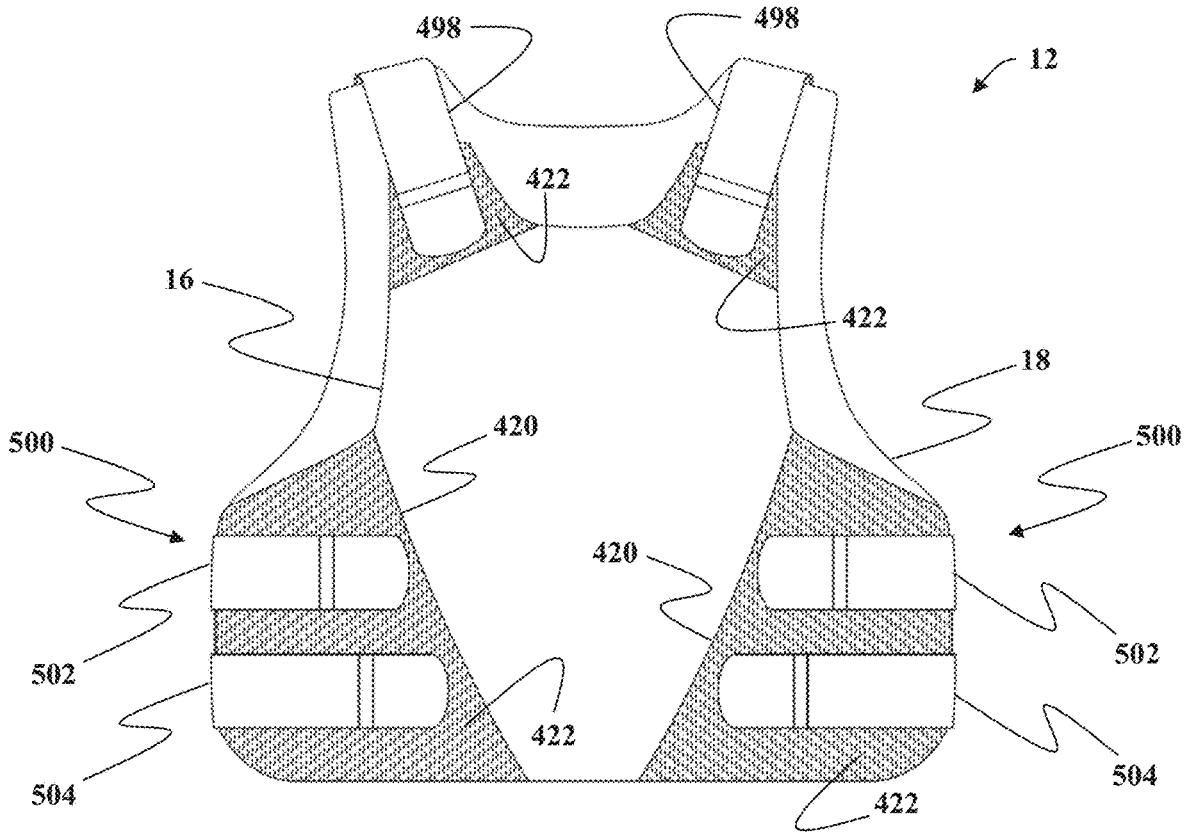
FIG. 2 is a front view of the carrier vest shown in FIG. 1.
Figure 3:
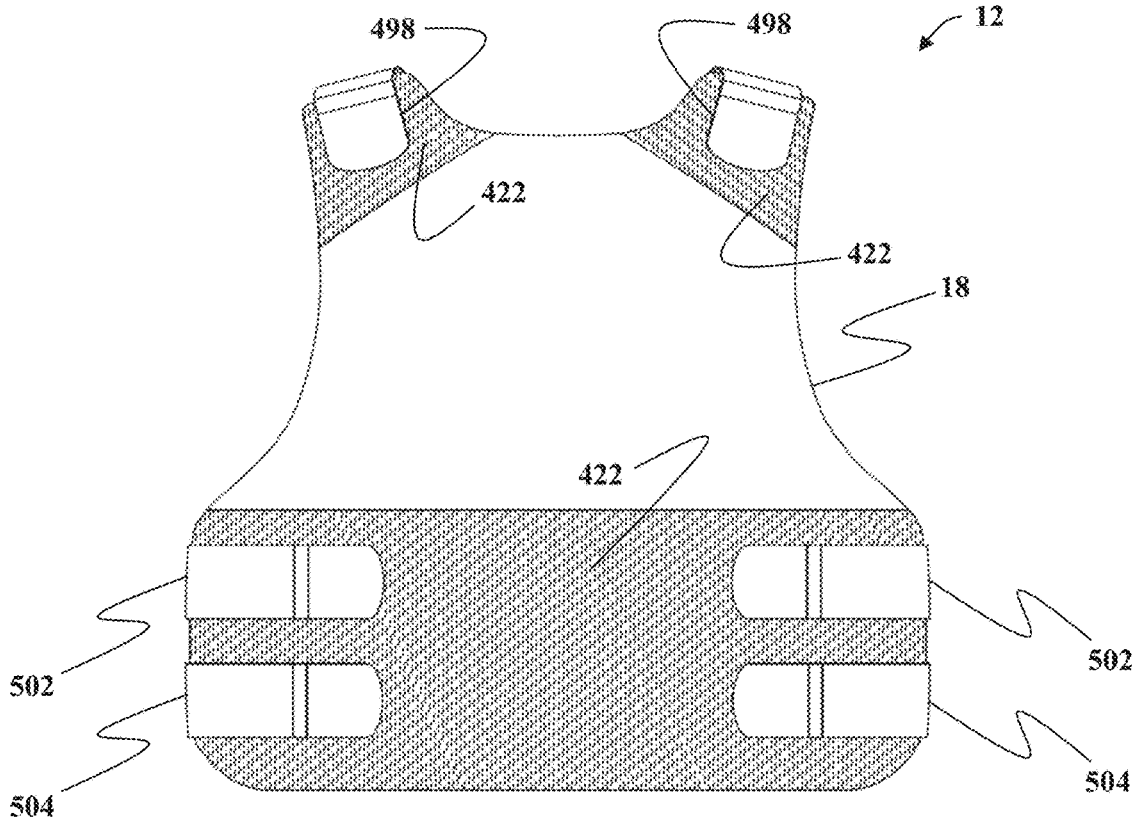
FIG. 3 is a rear view of the carrier vest shown in FIG. 1.
Figure 4:
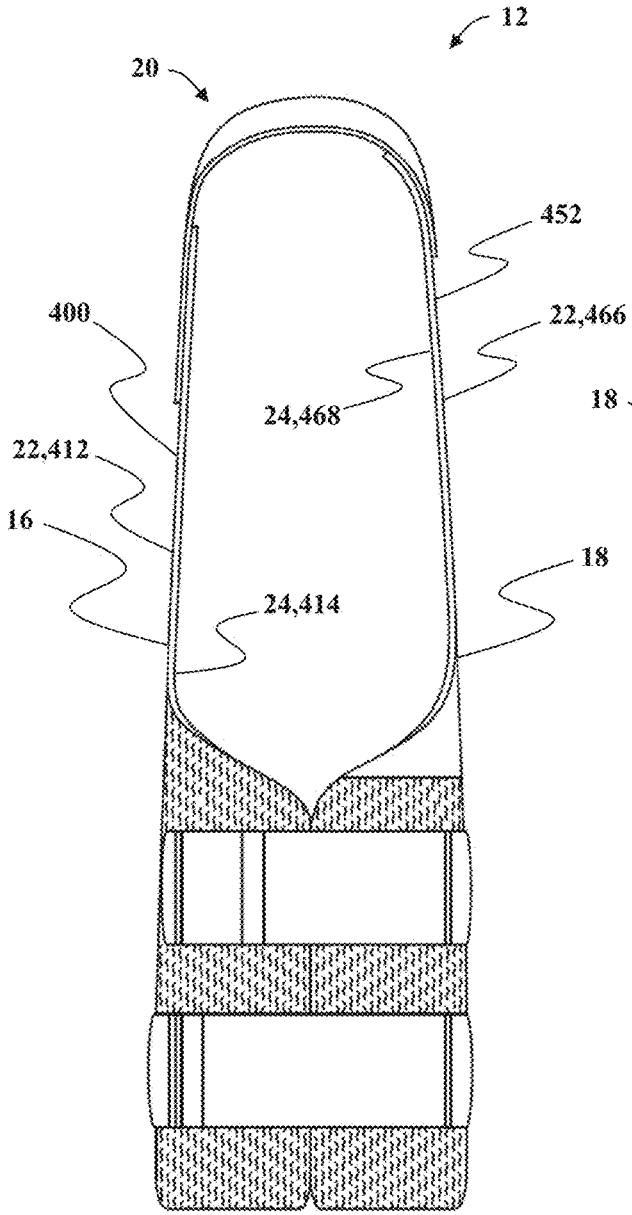
FIG. 4 is a left side view of the carrier vest shown in FIG. 1.
Figure 5:
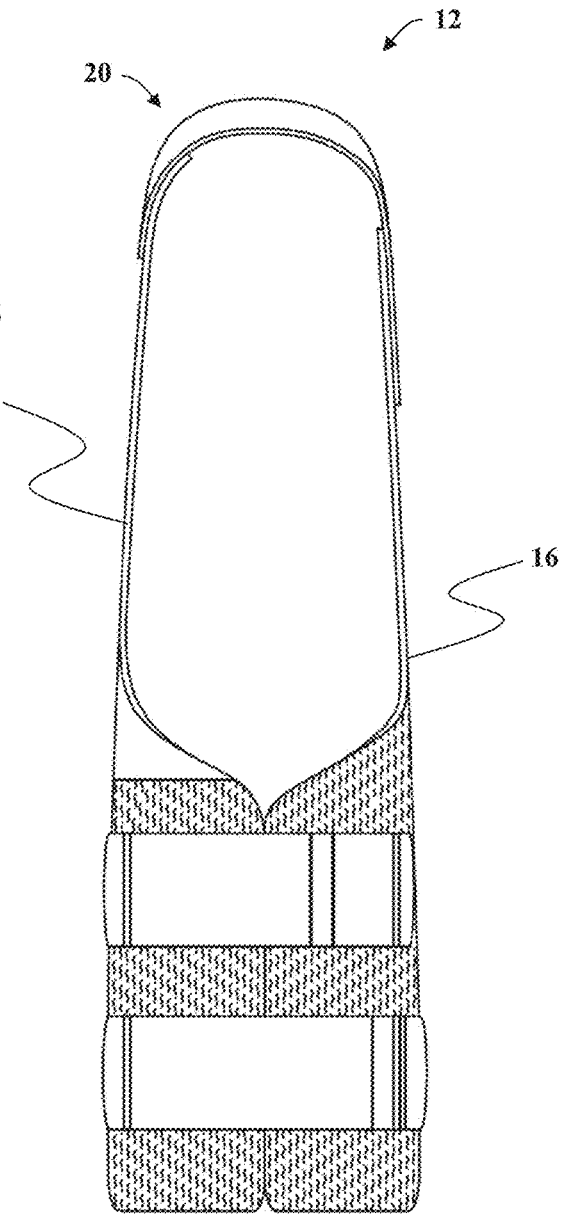
FIG. 5 is a right side view of the carrier vest shown in FIG. 1.
Figure 6:
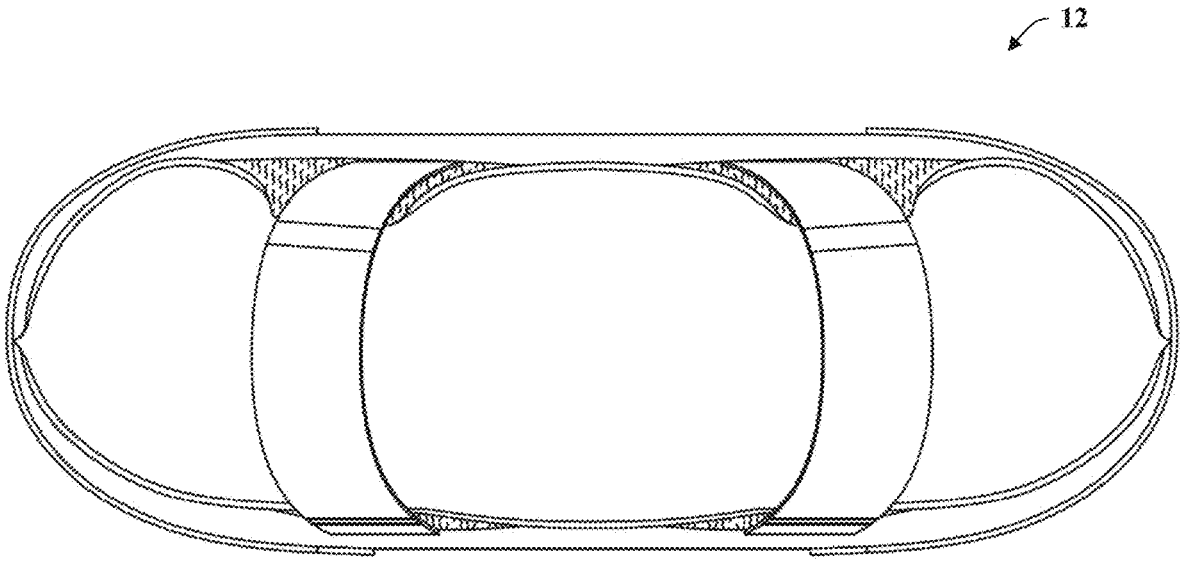
FIG. 6 is a top view of the carrier vest shown in FIG. 1.
Figure 7:
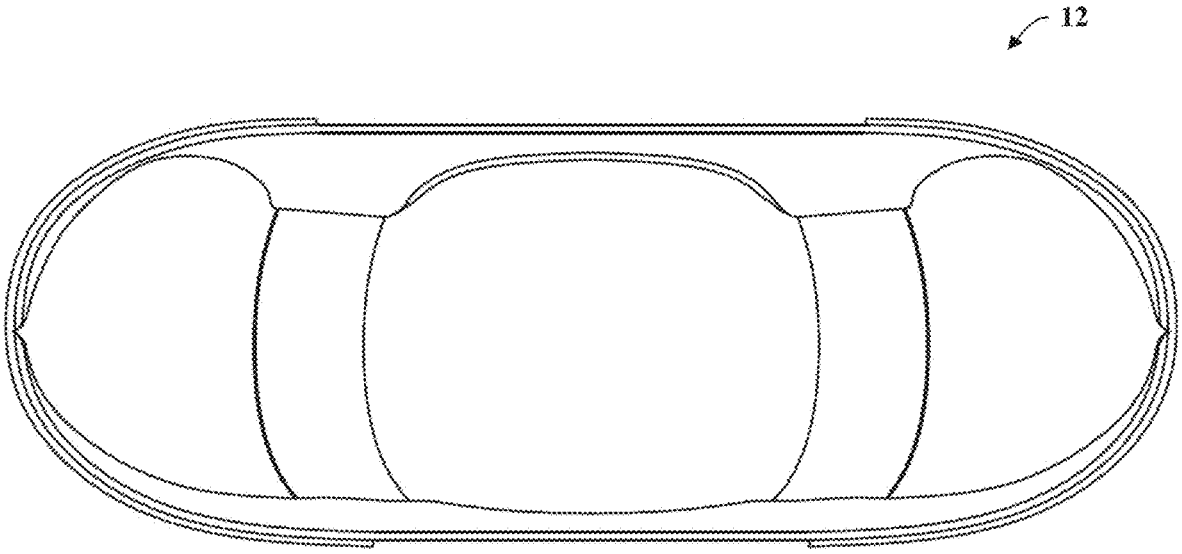
FIG. 7 is a bottom view of the carrier vest shown in FIG. 1.
Figure 8:
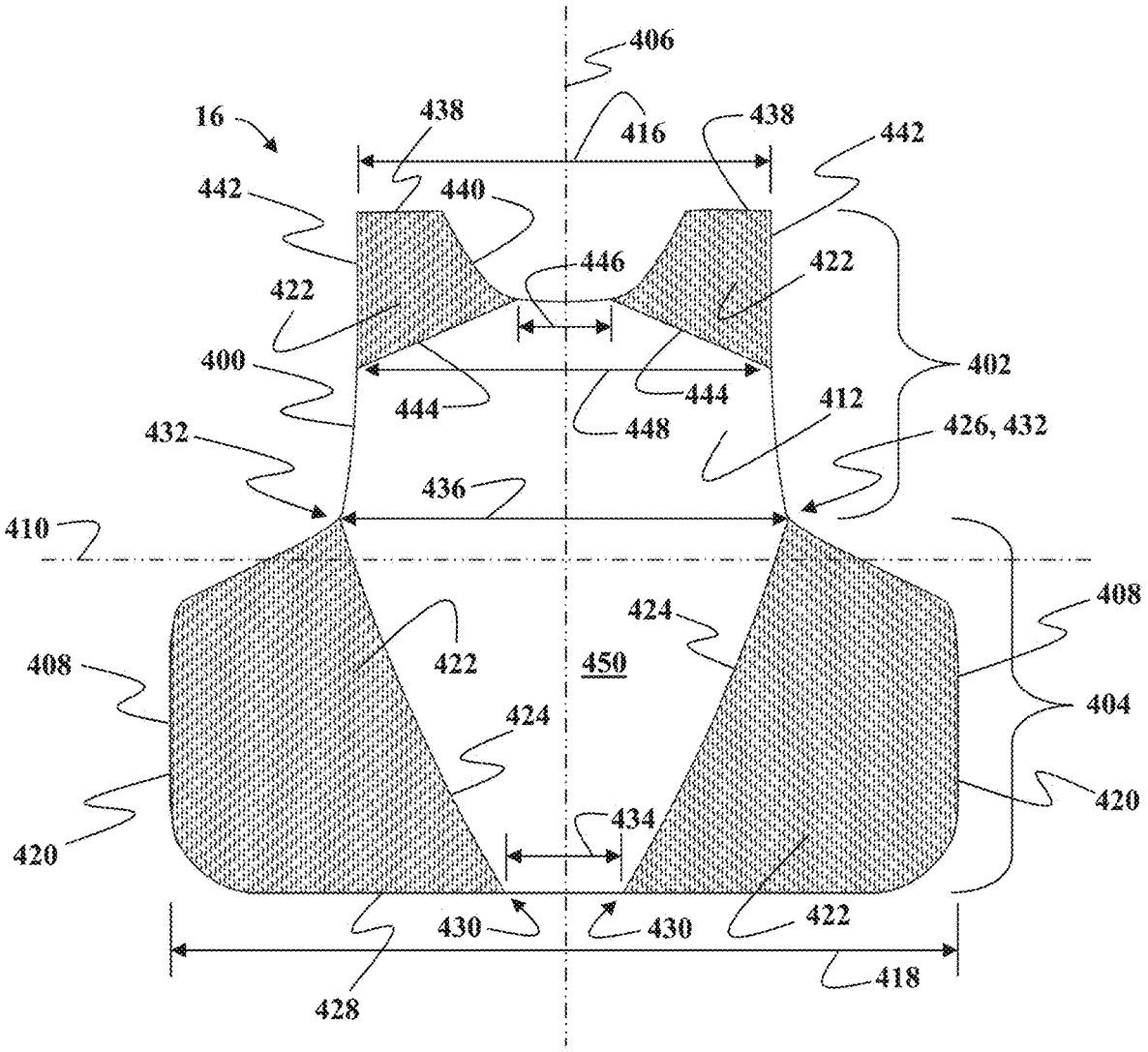
FIG. 8 is a front view of a portion of the carrier vest shown in FIG. 1.
Figure 9:
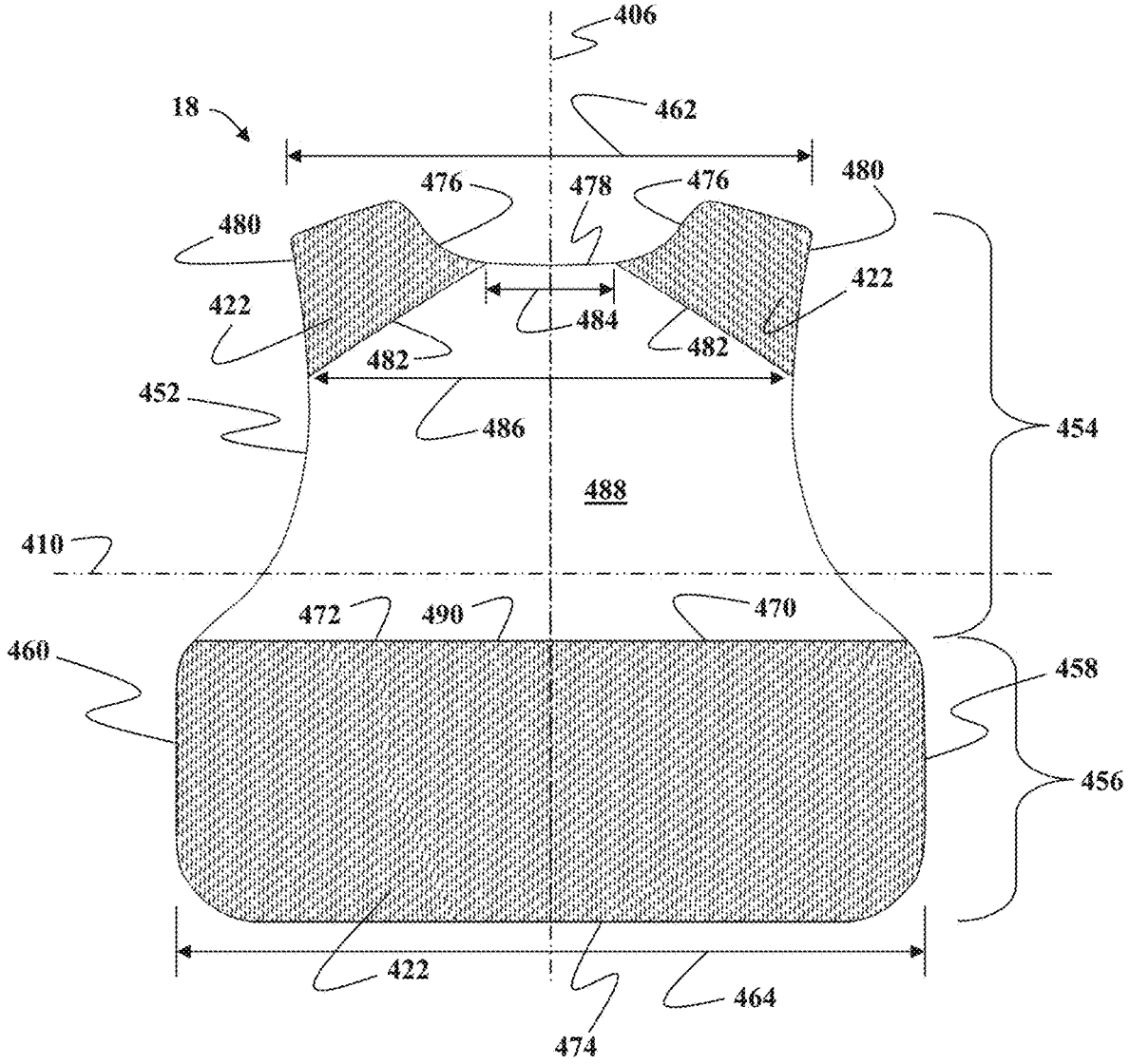
FIG. 9 is a rear view of a portion of the carrier vest shown in FIG. 1.
Figure 10:
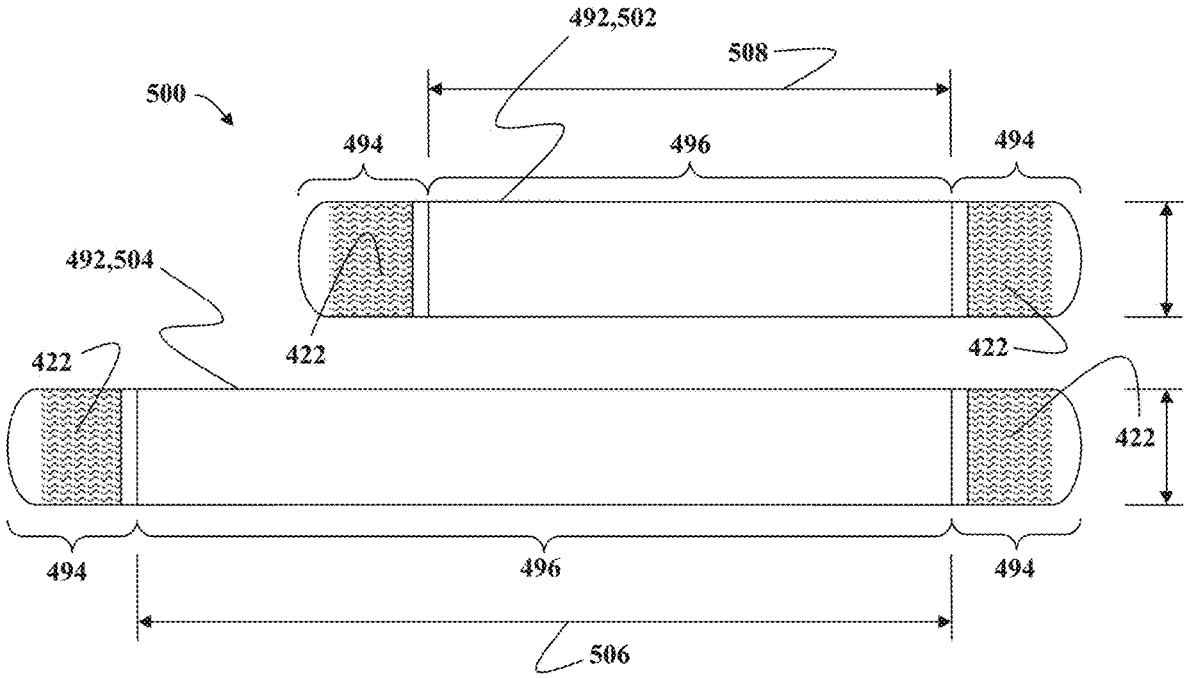
FIG. 10 is a schematic view of attachment straps that may be used with the carrier vest shown in FIG. 1.
Figure 11:
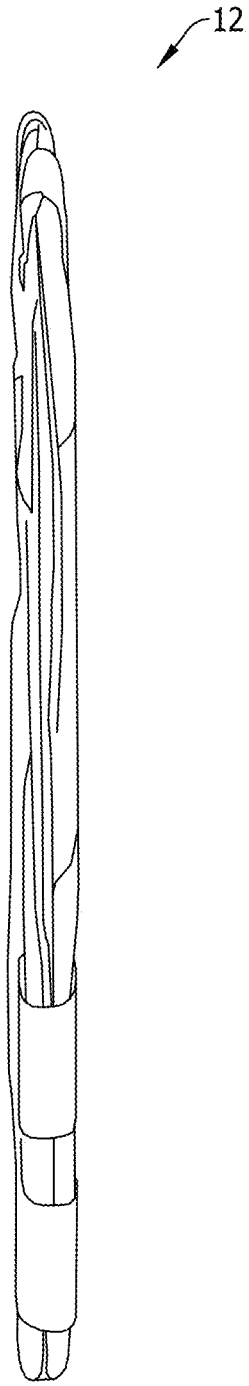
FIGS. 11-18 are perspective views of the personal protective vest assembly shown in FIG. 1.
Figure 12:
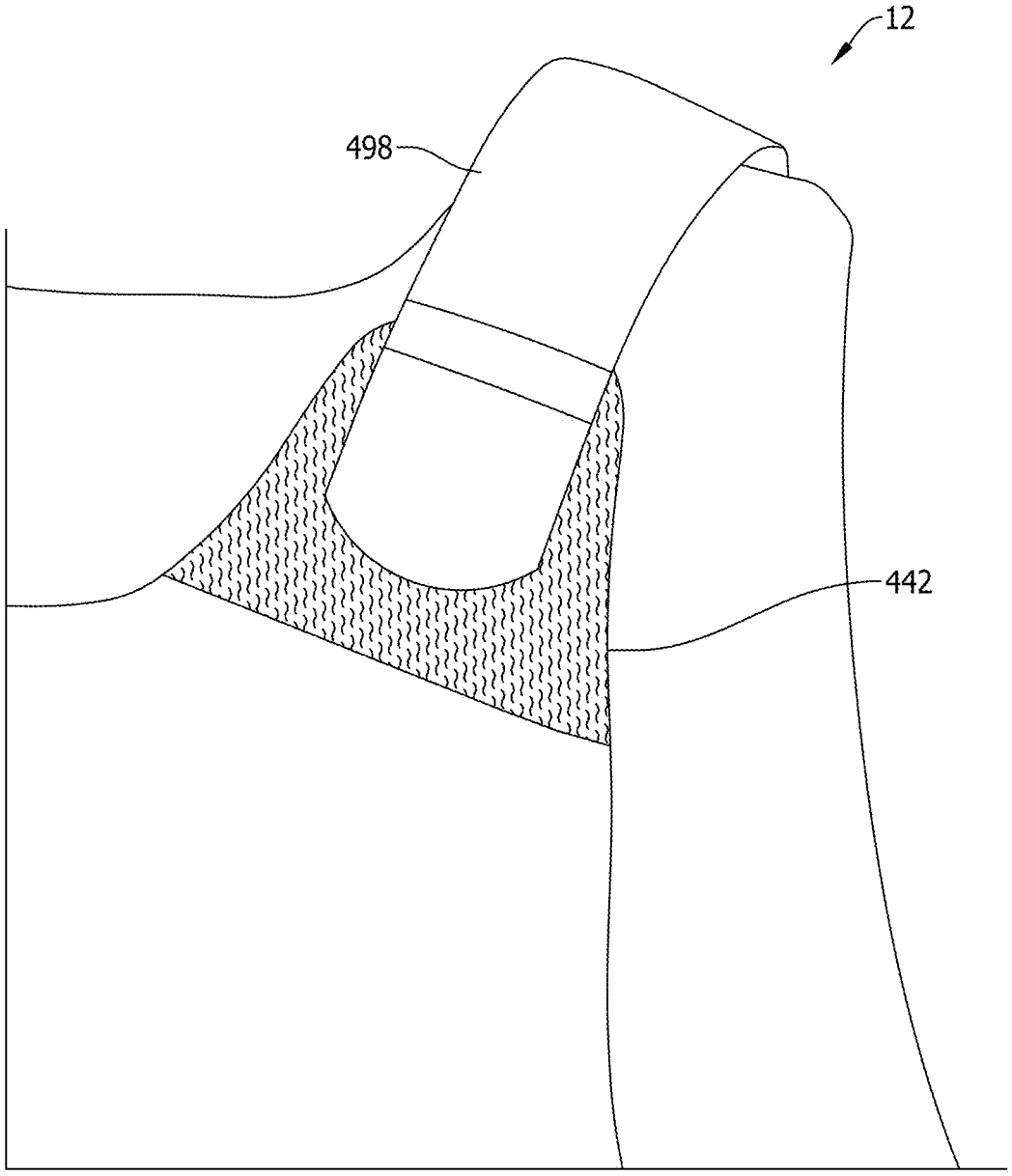
Figure 13:
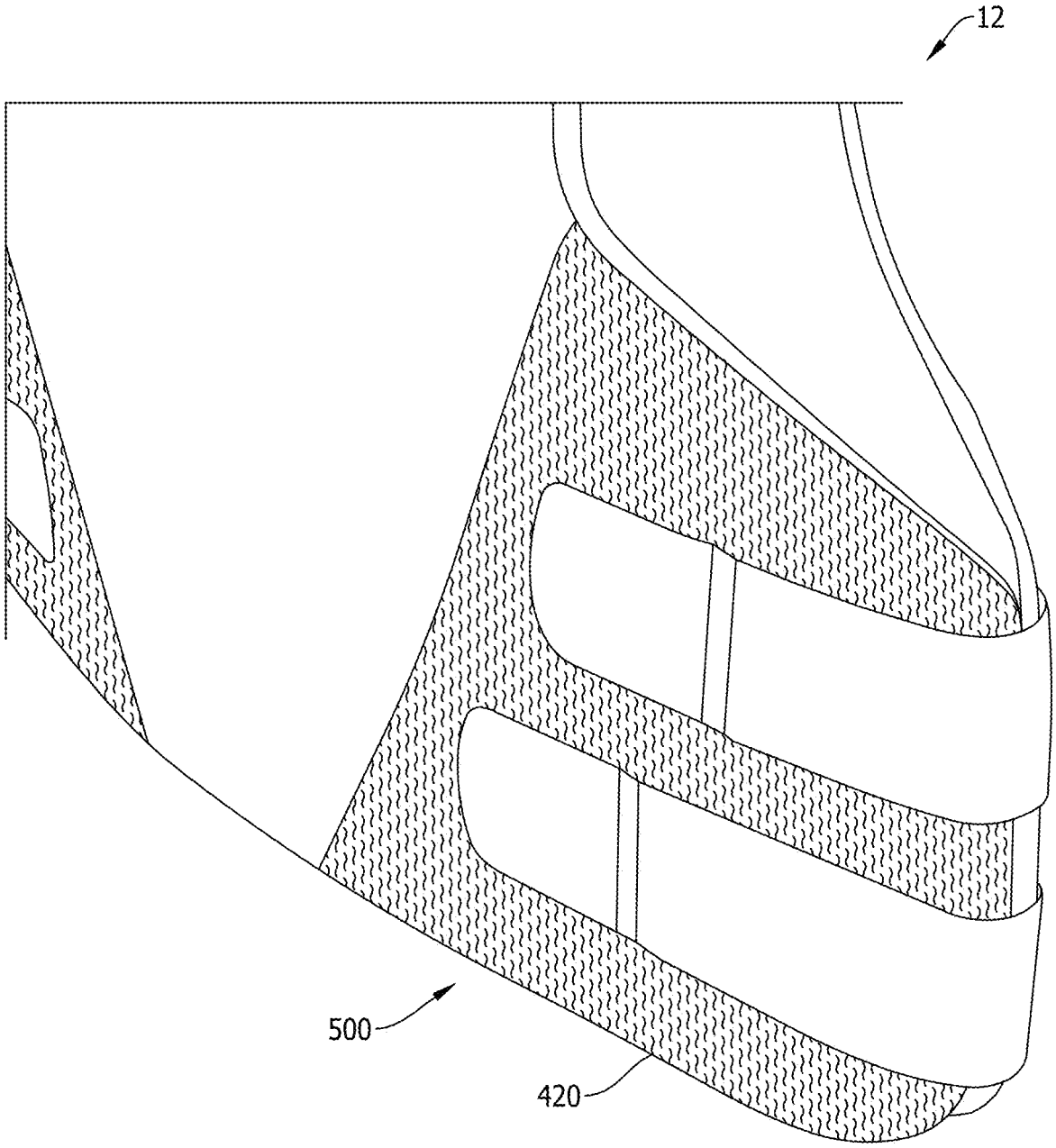
Figure 14:
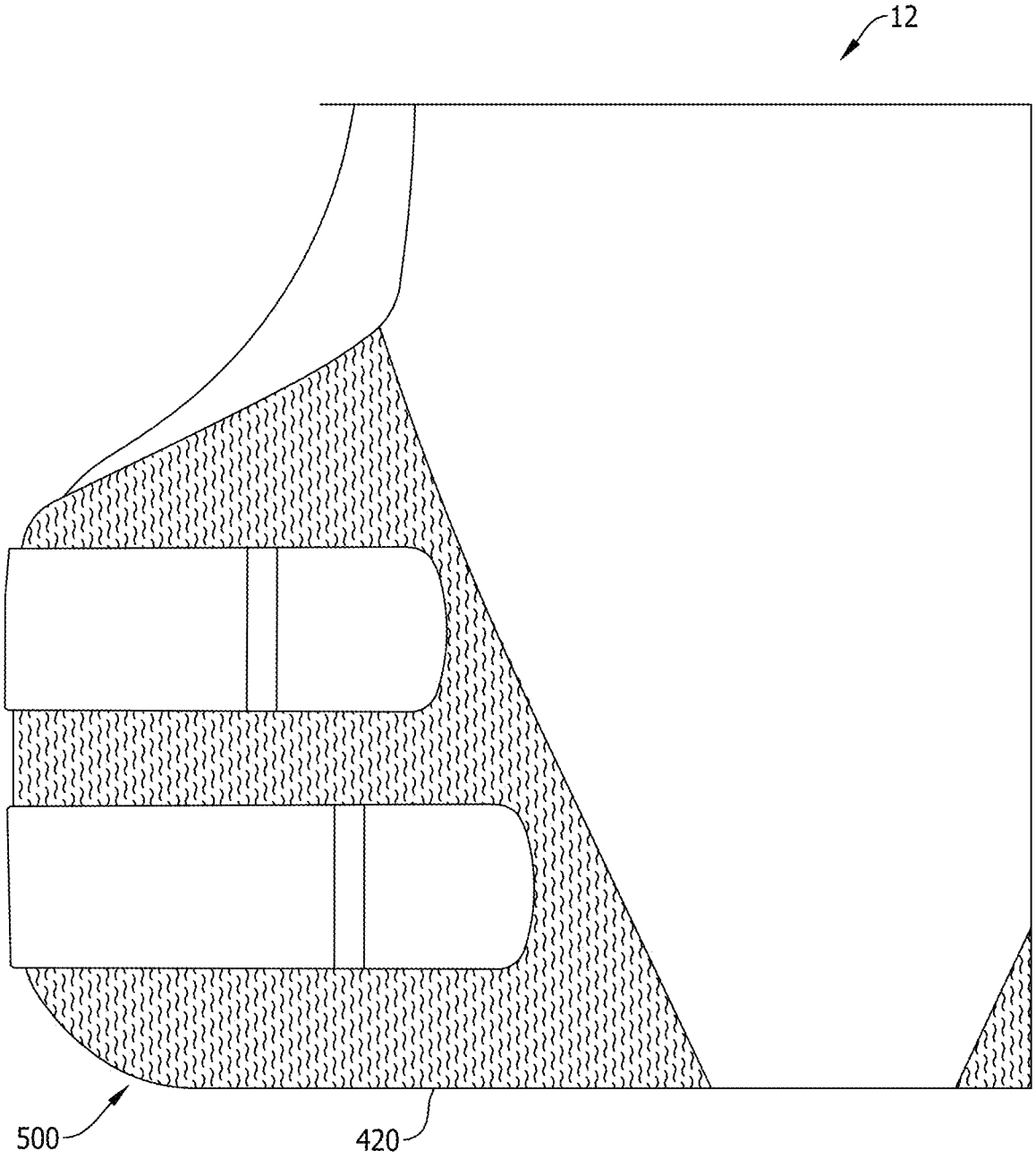
Figure 15:
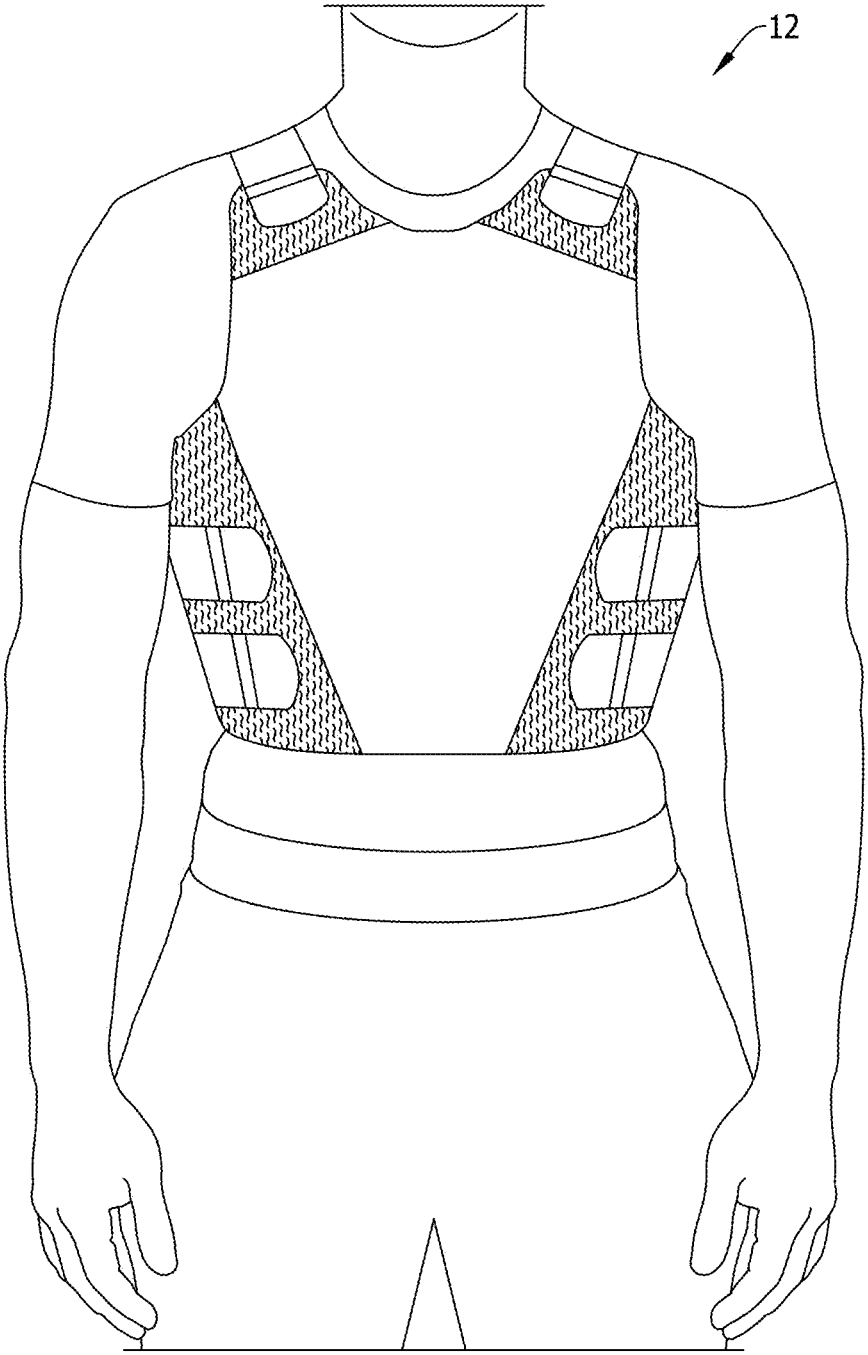
Figure 16:
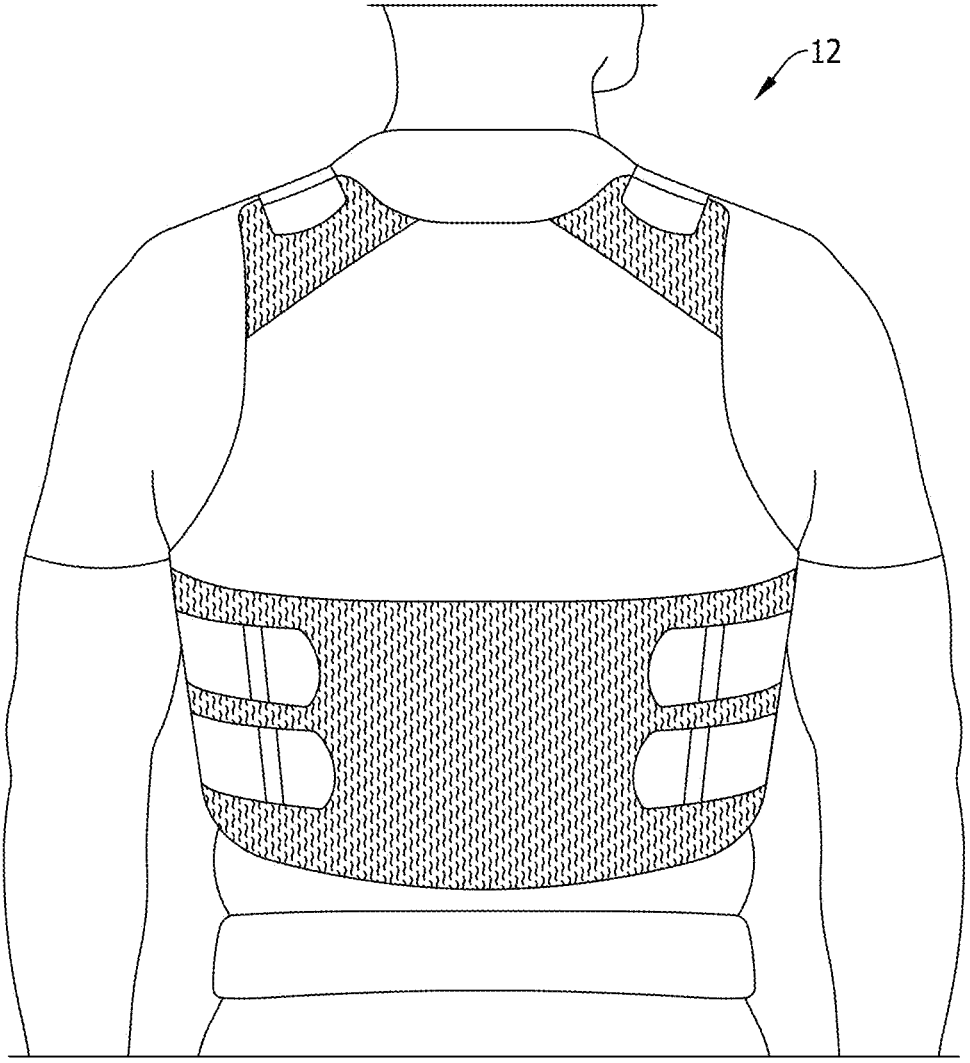
Figure 17:
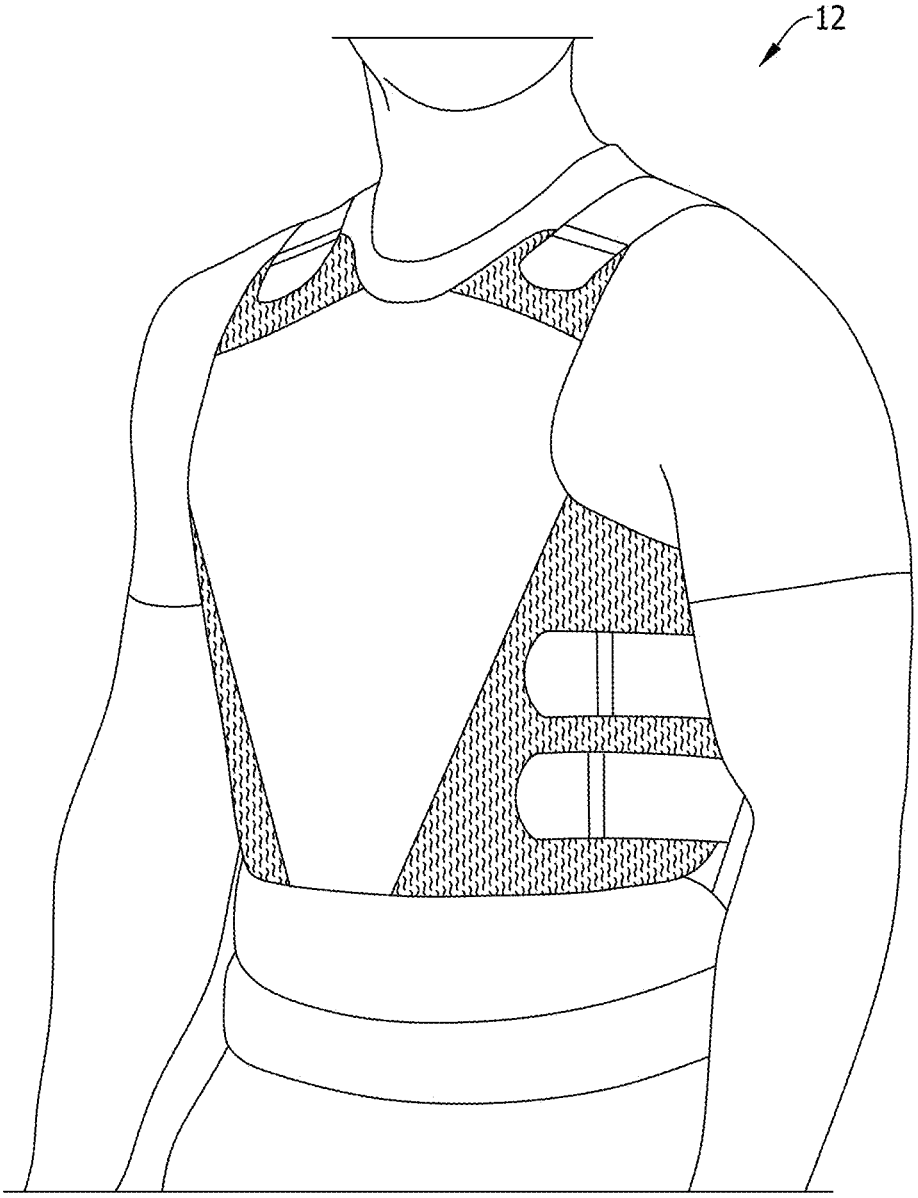
Figure 18:
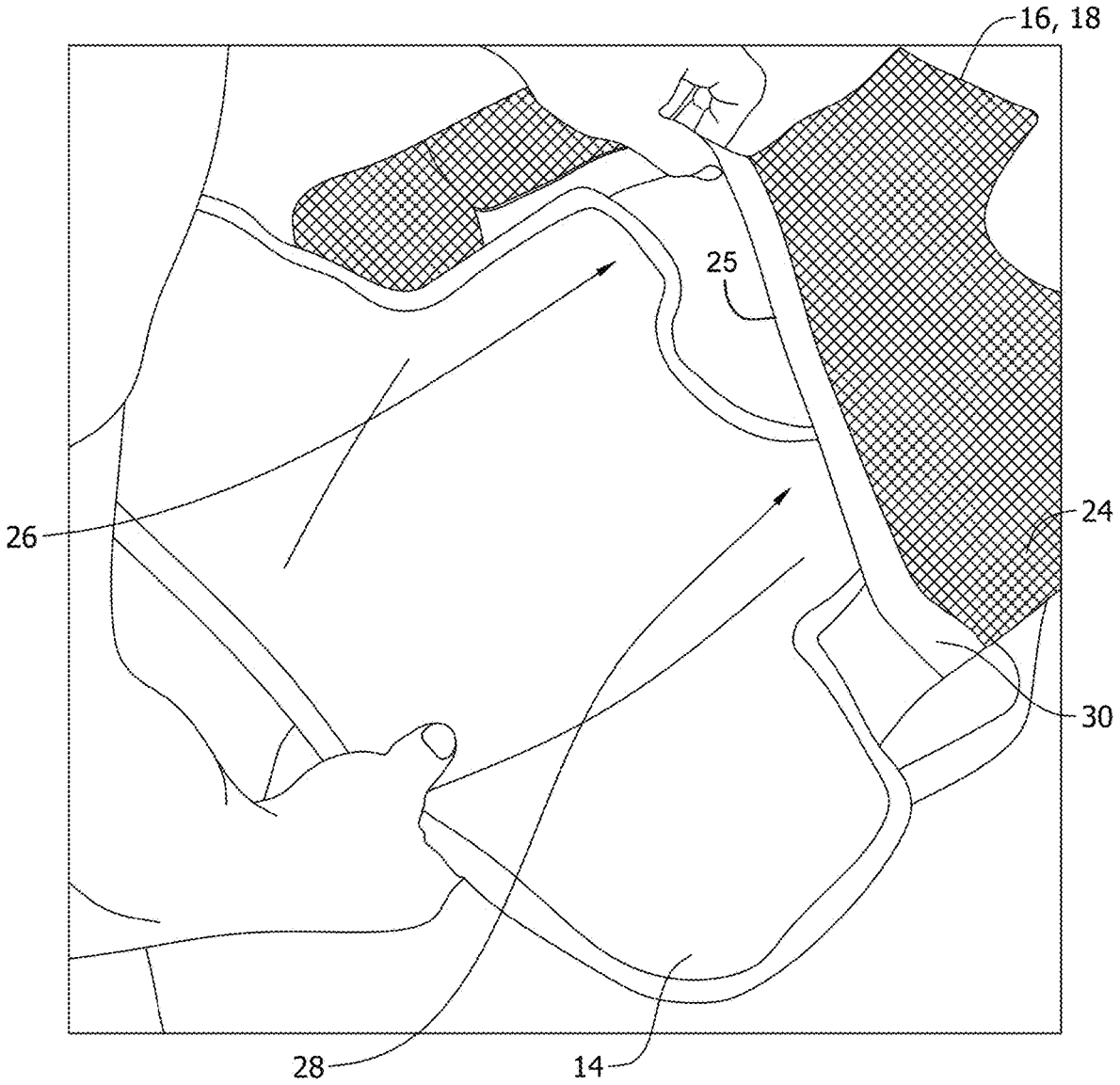

In the following description, numerous specific details are set forth in order to provide a thorough understanding of the present invention. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will be apparent, however, to one having ordinary skill in the art that the specific detail need not be employed to practice the present invention. In other instances, well-known materials or methods have not been described in detail in order to avoid obscuring the present invention.

In general, the present invention describes a personal protective vest system that includes a soft-flexible armor panel that is inserted into a personal protective vest. In some embodiments, the personal protective vest system includes the Hyperline™ soft-flexible armor panel provided by Safe Life Defense™.

Referring to FIGS. 1-27, in the illustrated embodiment, the present invention includes a personal protective vest assembly 10 that includes a wearable personal protective carrier vest 12 and one or more body armor panels 14 inserted into the carrier vest 12. In some embodiments, the carrier vest 12 is configured to be worn by a person covering a portion of the person's torso. In other embodiments, the personal protective vest assembly 10 may include other wearable protective articles that cover other areas of a person's body such as, for example, wearable protective articles covering the lower body, arms, legs, and head.

In some embodiments, the carrier vest 12 includes the Hyper Concealable™ Carrier™ provided by Safe Life Defense™ (shown in FIGS. 1-18). The carrier vest 12 is composed of: a main body fabric weighing less than: 0.39 lbs per square foot; a lightweight Velcro; the main garment (not including straps) contains materials that are overlapped and stitched or welded onto one another; and stitching composed of flatlock seams without overlapping materials. This carrier vest 12 uses materials and assembly methods to be as low profile as possible at only 0.03" thick. The carrier vest 12 includes the following features: Engineered specifically for Hyperline™ Soft Armor Panels; Incredibly thin: Only 0.03" thick; 12 point adjustable with Low Profile Ultrasonic Comfort Straps; Capable of being worn comfortably directly on the skin; DTF Ultra low profile non-itch tags; Water Resistant brushed polyester fabric; Flat Stitching.

In the illustrated embodiment, the carrier vest 12 includes a front vest panel assembly 16 and a rear vest panel assembly 18. In some embodiments, the front vest panel assembly 16 may be removable coupled to the rear vest panel assembly 18 with a vest fastening assembly 20. The vest fastening assembly 20 may include, for example, a Velcro™ assembly, a button assembly, and/or any suitable fasteners that allow the front vest panel assembly 16 to removable attach to the rear vest panel assembly 18.

Each vest panel assembly 16, 18 includes an outer surface 22 and an interior facing outer surface 24 adapted to be positioned adjacent to the person's body with the carrier vest 12 worn by the person, and an inner surface 25 defining a ballistic panel pocket 26. The ballistic panel pocket 26 is defined between the outer surface 22 and the interior facing outer surface 24. The ballistic panel pocket 26 is sized and shaped to receive a body armor panel 14 therein such that the body armor panel 14 is positioned within the ballistic panel pocket 26. In some embodiments, the interior facing outer surface 24 also includes a slot 28 defined along the interior facing outer surface 24 to provide access to the ballistic panel pocket 26 to insert and/or remove body armor panel 14. A slot fastening assembly 30 may be defined along the slot 28 to allow the ballistic panel pocket 26 to be selectively sealed. The slot fastening assembly 30 may include, for example, a Velcro assembly, a button fastener assembly, and/or any suitable fasteners that allow the slot 28 and ballistic panel pocket 26 to be sealed.

In the illustrated embodiment, the front vest panel assembly 16 is adapted to overlay a chest of the wearer and the rear vest panel assembly 18 adapted to overlay a back of the wearer. The front vest panel assembly 16 includes a front vest panel body 400 extending between a front vest upper portion 402 and a front vest lower portion 404 along a vertical axis 406, and between opposing front vest side edges 408 along a horizontal axis 410. The front vest panel body 400 includes a forward facing outer surface 412, an interior facing outer surface 414, and an inner surface 25 defining a front vest ballistic panel pocket 26 therein. The front vest upper portion 402 defines a front vest upper width 416 of the front vest panel assembly 16 along the horizontal axis 410 and the front vest lower portion 404 defines a front vest lower width 418 of the front vest panel assembly 16 along the horizontal axis 410 that is larger than the front vest upper width 416.

The forward facing outer surface 412 includes a pair of lower front vest fastening sections 420 defined along the front vest lower portion 404 and orientated in a mirrored relationship along the vertical axis 406. Each lower front vest fastening section 420 includes hook & loop fabric material 422 (e.g., Velcro™) extending from a corresponding front vest side edge 408 towards a center of the front vest lower portion 404. Each lower front vest fastening section 420 includes an interior edge 424 that is spaced a distance from the corresponding front vest side edge 408 and has a concave arcuate shape extending from an upper end 426 of the front vest lower portion 404 to a bottom edge 428 of the forward facing outer surface 412 such that a lower end 430 of the interior edge 424 adjacent the bottom edge 428 of the forward facing outer surface 412 is closer to the center of the front vest lower portion 404 than a top end 432 of the interior edge 424. The pair of lower front vest fastening sections 420 are orientated in a mirrored relationship along the vertical axis 406 such that a lower gap 434 is defined between the lower ends 430 of the opposing interior edges 424, and an upper gap 436 is defined between the top ends 432 of the opposing interior edges 424 that is larger than the lower gap 434.

The front vest upper portion 402 also includes opposing shoulder portions 438 defining an arcuate concave neckline 440. The forward facing outer surface 412 includes a pair of opposing upper front vest fastening sections 442 defined along the front vest upper portion 402 and orientated in a mirrored relationship along the vertical axis 406. Each upper front vest fastening section 442 includes hook & loop fabric material 422 extending across a corresponding shoulder portion 438 and including a bottom edge 444 extending from the neckline 440 to a corresponding front vest side edge 408 at a downward oblique angle such that an upper gap 446 is defined between the top ends of the opposing bottom edges 444 and a lower gap 448 is defined between the lower ends of the opposing bottom edges 444 that is larger than the upper gap 446.

The front vest panel assembly 16 also includes a front vest central portion 450 having a smooth surface extending between each lower front vest fastening section 420 and each upper front vest fastening section 442. In some embodiments, the front vest central portion 450 is coupled to the lower front vest fastening sections 420 and to the upper front vest fastening sections 442 via flat stitching formed along the interior edges 424 of the lower front vest fastening sections 420 and the bottom edges 444 of the upper front vest fastening sections 442.

A first flexible body armor panel 14 is positioned within the front vest ballistic panel pocket 26 and includes a ballistic material panel including a plurality of layered material segments defined between a strike face and a wear face with each of the layered material segments including a different ballistic material. In some embodiments, the first flexible body armor panel 14 defines a perimeter shape that is substantially the same as a perimeter shape of the front vest panel body 400.

In the illustrated embodiment, the rear vest panel assembly 18 includes a rear vest panel body 452 extending between a rear vest upper portion 454 and a rear vest lower portion 456 along the vertical axis 406, and between a first rear vest side edge 458 and an opposing second rear vest side edge 460 along the horizontal axis 410. The rear vest upper portion 454 defines a rear vest upper width 462 of the rear vest panel assembly 18 along the horizontal axis 410 and the rear vest lower portion 456 defines a rear vest lower width 464 of the rear vest panel assembly 18 along the horizontal axis 410 that is larger than the rear vest upper width 462. In some embodiments, the rear vest upper width 462 is larger than the front vest upper width 416 of the front vest panel assembly 16, and the rear vest lower width 464 is substantially equal in length to the front vest lower width 418.

In the illustrated embodiment, the rear vest panel body 452 includes a rear vest forward facing outer surface 466 and a rear vest interior facing outer surface 468. The rear vest panel body 452 also includes a rear vest inner surface 25 defining a rear vest ballistic panel pocket 26 therein. A second flexible body armor panel 14 is positioned within the rear vest ballistic panel pocket 26 and may include a ballistic material panel that is similar to the ballistic material panel of the first flexible body armor panel 14. In some embodiments, the second flexible body armor panel 14 defines a perimeter shape that is substantially the same as a perimeter shape of the rear vest panel body 452.

The rear vest forward facing outer surface 466 includes a lower rear vest fastening section 470 that is defined along the rear vest lower portion 456 and includes hook & loop fabric material 422 extending from a top end 472 of the rear vest lower portion 456 to a bottom edge 474 of the rear vest forward facing outer surface 466, and from the first rear vest side edge 458 to the opposing second rear vest side edge 460.

The rear vest upper portion 454 also includes opposing rear vest shoulder portions 476 defining an arcuate concave rear vest neckline 478 therebetween. The rear vest forward facing outer surface 466 includes a pair of opposing upper rear vest fastening sections 480 defined along the rear vest upper portion 454 and orientated in a mirrored relationship along the vertical axis 406. Each upper rear vest fastening section 480 includes hook & loop fabric material 422 extending across a corresponding rear vest shoulder portion 476 and including a bottom edge 482 extending from the rear vest neckline 478 to a corresponding rear vest side edge 458, 460 at a downward oblique angle such that a rear vest upper gap 484 is defined between the top ends of the opposing bottom edges 482 and a rear vest lower gap 486 is defined between the lower ends of the opposing bottom edges 482 that is larger than the rear vest upper gap 484.

The rear vest panel assembly 18 includes a rear vest central portion 488 having a smooth surface extending between the lower rear vest fastening section 470 and each of the upper rear vest fastening sections 480. The rear vest central portion 488 is coupled to the lower rear vest fastening section 470 and to the upper rear vest fastening sections 480 via flat stitching formed along a top edge 490 of the lower rear vest fastening section 470 and the bottom edges 482 of the upper rear vest fastening sections 480.

The vest fastening assembly 20 includes a plurality of attachment straps 492 that are removably coupled to the front vest panel assembly 16 and the rear vest panel assembly 18. Each attachment strap 492 includes a pair of opposing fastening tabs 494 that each including hook & loop fabric material 422 defined along an outer surface to facilitate removable coupling the attachment strap 492 to the corresponding hook & loop fabric material 422 defined along the front vest forward facing outer surface 412 and the rear vest forward facing outer surface 466. Each attachment strap 492 also includes a flexible section 496 including an elastic material extending between the opposing fastening tabs 494 to enable the wearer to adjust a width and overall fit of the carrier vest 12 around the wearer's body.

In the illustrated embodiment, the vest fastening assembly 20 includes a pair of upper attachment straps 498 that are removably coupled to a corresponding upper front vest fastening section 442 and a corresponding upper rear vest fastening section 480. The vest fastening assembly 20 also includes two pairs of side attachment straps 500 with each pair of side attachment straps 500 removably coupled to the lower rear vest fastening section 470 and a corresponding lower front vest fastening section 420. Each pair of side attachment straps 500 includes an upper side attachment strap 502 and a lower side attachment strap 504. The lower side attachment strap 504 is positioned closer to a bottom of the carrier vest 12 than the upper side attachment strap 502, and includes a length 506 defined between corresponding opposing fastening tabs 494 that is longer than a length 508 of the upper side attachment strap 502.

By providing the forward facing outer surface 412 having opposing lower front vest fastening sections 420 with concave arcuate shape interior edges 424 and corresponding side attachment straps 500 including upper and lower side attachment straps 502, 504, the ability of the wearer to adjust the width and overall fit of the carrier vest 12 is improved.

In the illustrated embodiment, the body armor panel 14 includes an outer cover 32 that defines a panel assembly cavity 34 and a ballistic material panel assembly 36 that is positioned within the panel assembly cavity 34. The outer cover 32 may include a 30 denier thermoplastic polyurethane laminated nylon fabric. In some embodiments, the body armor panel 14 includes a cross-sectional shape substantially similar to the cross-sectional shape of the corresponding vest panels 16, 18. In other embodiments, the body armor panel 14 may include any suitable cross-sectional shape to facilitate covering any portion of a person's body.

The ballistic material panel assembly 36 includes a plurality of layered material segments 38, 40, 42, 44 defined between a strike face 46 and a wear face 48, with each of the layered material segments 38, 40, 42, 44 including a different ballistic material. When positioned within the ballistic panel pocket 26 the strike face 46 is orientated near the outer surface 22 of the corresponding vest panel 16, 18 and the wear face 48 is orientated near the interior facing outer surface 24 of the corresponding vest panel 16, 18 such that the wear face 48 is closer to a person's body than the strike face 46 with the carrier vest 12 worn by the person.

In the illustrated embodiment, the plurality of layered material segments includes a first layered material segment 38 that includes a layer of a first ballistic material 50, a second layered material segment 40 that is adjacent the first layered material segment 38 and includes a plurality of layers of a second ballistic material 52, a third layered material segment 42 that is adjacent the second layered material segment 40 and includes a plurality of layers of a third ballistic material 54, and a fourth layered material segment 44 that is adjacent the third layered material segment 42 and includes a plurality of layers of a fourth ballistic material 56. The first layered material segment 38 defines the strike face 46 and the fourth layered material segment 44 defines the wear face 48. A number of layers of the third ballistic material 54 is greater than a number of layers of the second ballistic material 52, and a number of layers of the fourth ballistic material 56 is less than the number of layers of the third ballistic material 54.

Figure 23:
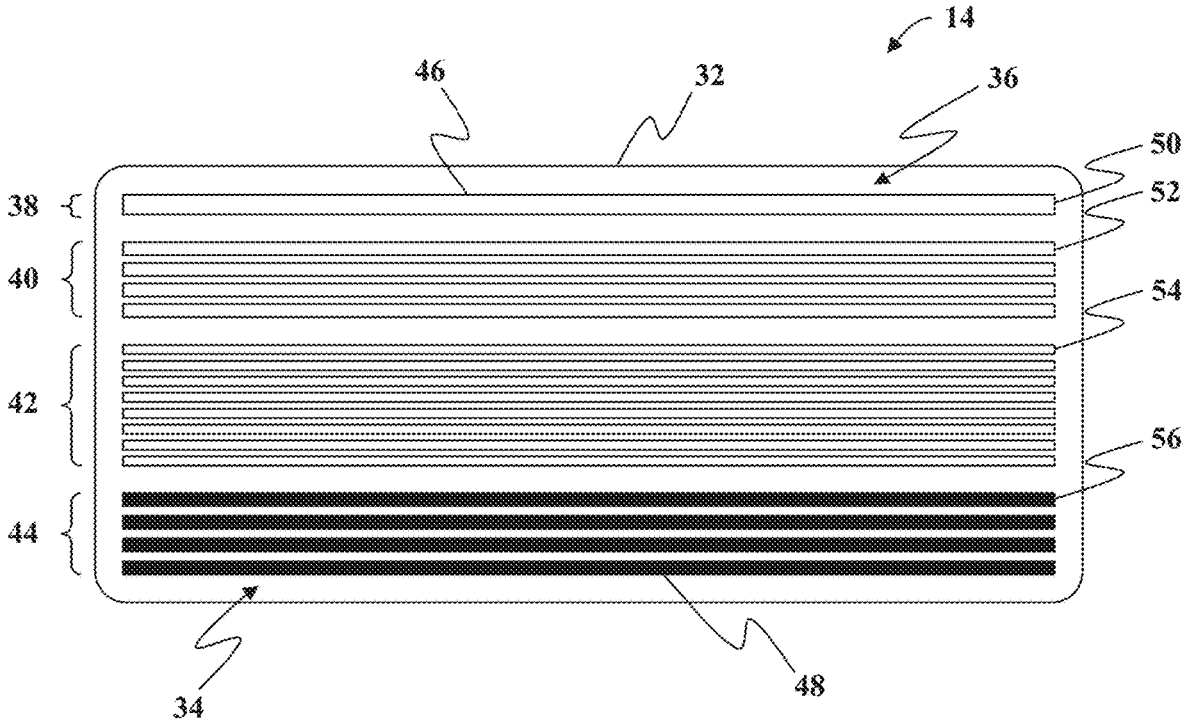
FIGS. 23 and 24 are schematic cross-sectional views of the body armor panel shown in FIGS. 19-22.

In some embodiments, as shown in FIG. 23, the first layered material segment 38 includes a single layer of the first ballistic material 50, the second layered material segment 40 includes four layers of the second ballistic material 52, the third layered material segment 42 includes eight layers of the third ballistic material 54, and the fourth layered material segment 44 includes four layers of the fourth ballistic material 56. In other embodiments, each segment 38, 40, 42, 44 may include any suitable number of layers of corresponding ballistic material.

The first ballistic material 50 includes an ultra-high molecular weight polyethylene fiber based composite laminate having an Areal density of about between 226 g/m$^2$ and 240 g/m$^2$ including four single layers of unidirectional sheet cross plied at 90 degrees to each other and consolidated with a rubber based matrix. In some embodiments, the first ballistic material may include DSM Dyneema® HB50 with the first layered material segment 38 includes a single layer of DSM Dyneema® HB50.

The second ballistic material 52 includes an ultra-high molecular weight polyethylene fiber based composite laminate having an Areal density of about between 208 g/m$^2$ and 224 g/m$^2$ including six single layers of unidirectional sheet cross plied at 90 degrees to each other and consolidated with a rubber based matrix. In some embodiments, the second ballistic material may include DSM Dyneema® SB117 with the second layered material segment 40 including four layers of DSM Dyneema® SB117.

The third ballistic material 54 includes para-aramid unidirectional material including four plies of para-aramid unidirectional material cross-plied in 0°/90°/0°/90° configuration. In some embodiments, the third ballistic material 54 may include Barrday Advanced Material Solutions™ U611 with the third layered material segment 42 including eight layers of Barrday Advanced Material Solutions™ U611.

The fourth ballistic material 56 includes a woven and laminated material having an Areal density of about 516 g/m$^2$. In some embodiments, the fourth ballistic material 56 may include Barrday Advanced Material Solutions™ FCKER1017160-01129 with the fourth layered material segment 44 including four layers of Barrday Advanced Material Solutions™ FCKER1017160-01129.

Figure 24:
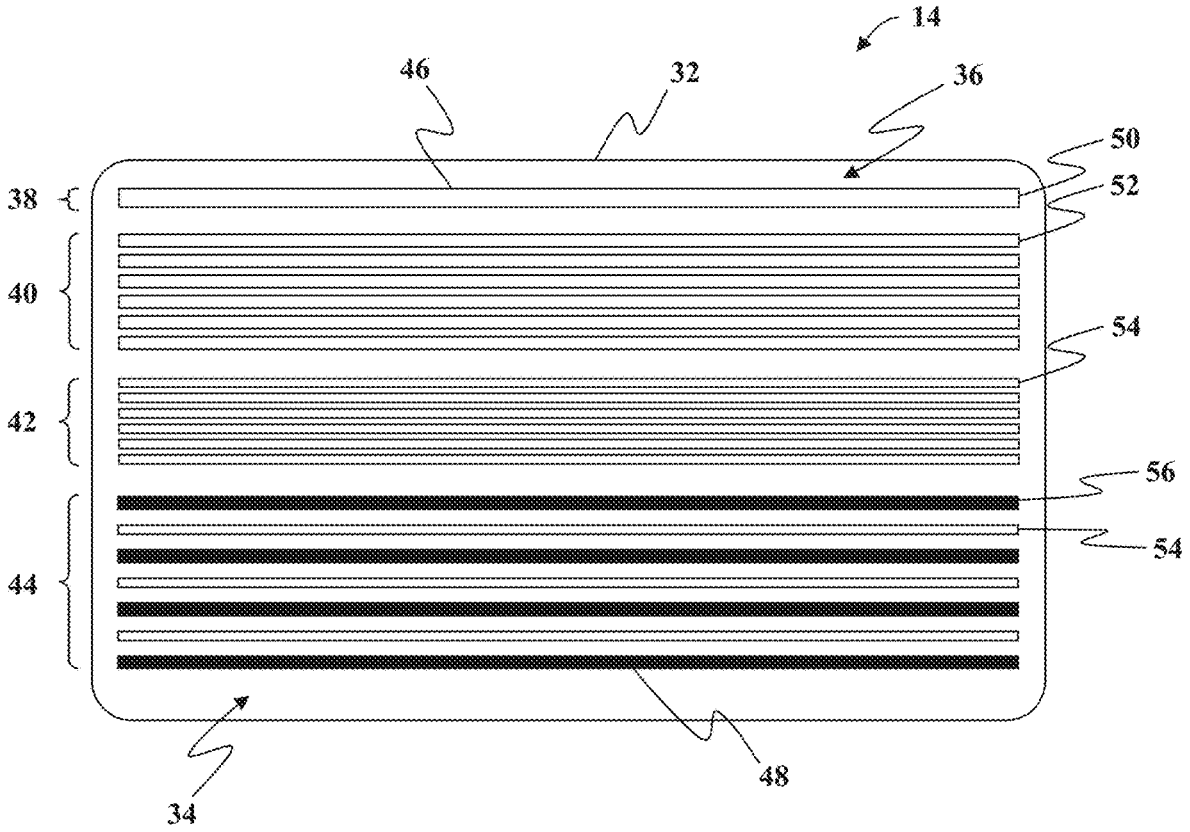
Figure 25:
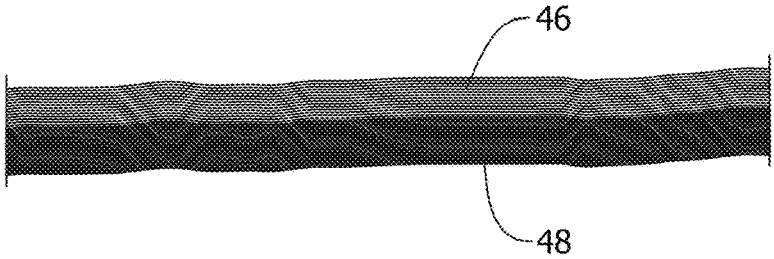
FIG. 25 is a cross-sectional view of the body armor panel shown in FIG. 23.
Figure 26:
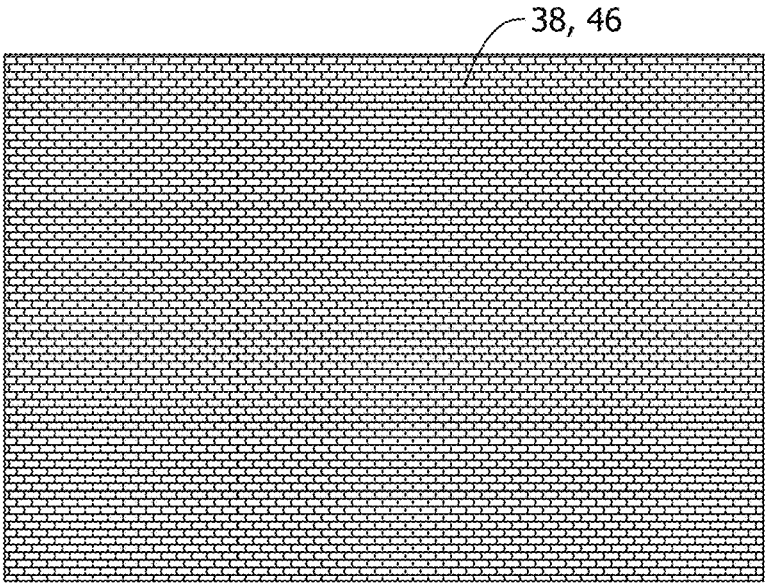
FIG. 26 is a partial view of a strike face of the body armor panel shown in FIG. 23.
Figure 27:
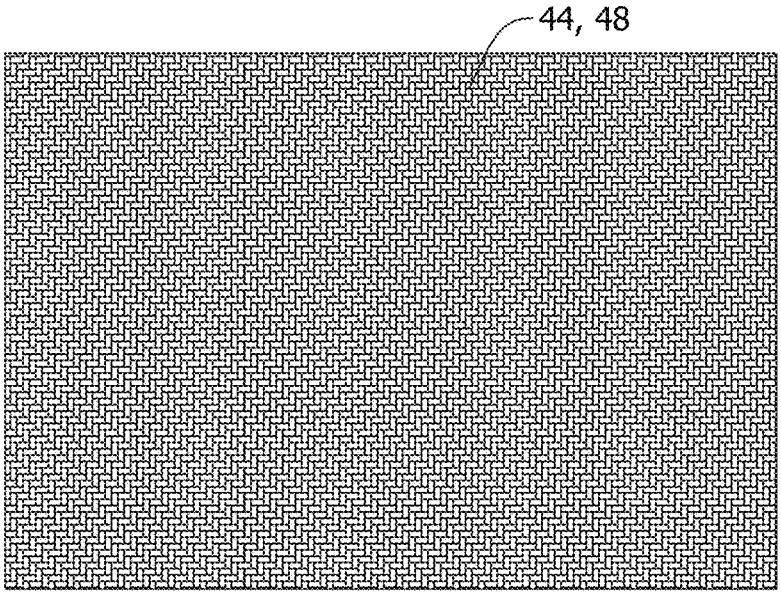
FIG. 27 is a partial view of a wear face of the body armor panel shown in FIG. 23.

As shown in FIG. 24, in some embodiments, the plurality of layered material segments includes the first layered material segment 38 including a single layer of the first ballistic material 50, the second layered material segment 40 including six layers of the second ballistic material 52, the third layered material segment 42 including six layers of the third ballistic material 54, and the fourth layered material segment 44 including a plurality of layers of the third ballistic material 54 and a plurality of layers of the fourth ballistic material 56 positioned in an alternating layered arrangement such that each layer of the third ballistic material 54 is positioned between corresponding layers of the fourth ballistic material 56. For example, the fourth layered material segment 44 may include four layers of the fourth ballistic material 56 interlaced with three layers of the third ballistic material 54 such that a top layer of fourth ballistic material 56 is adjacent a bottom layer of third ballistic material 54 of the third layered material segment 42, and a bottom layer of fourth ballistic material 56 defines the wear face 48.

Figure 19:
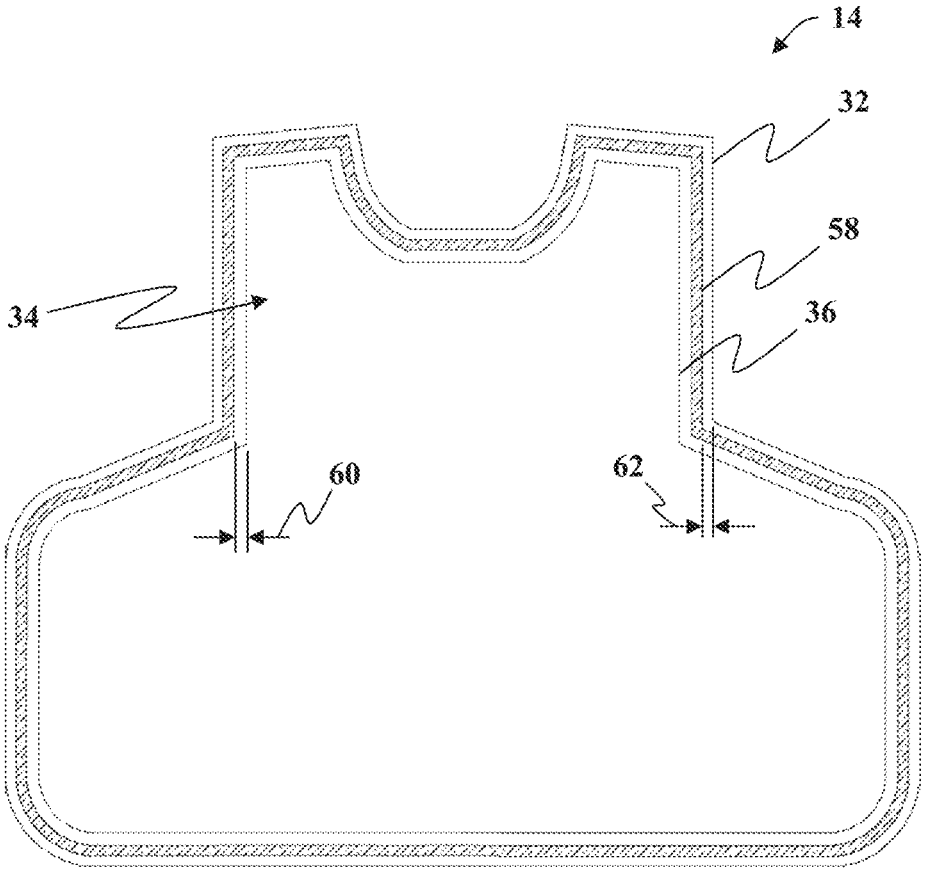
FIGS. 19-22 are schematic views of a body armor panel that may be used with the personal protective vest assembly shown in FIG. 1.
Figure 20:
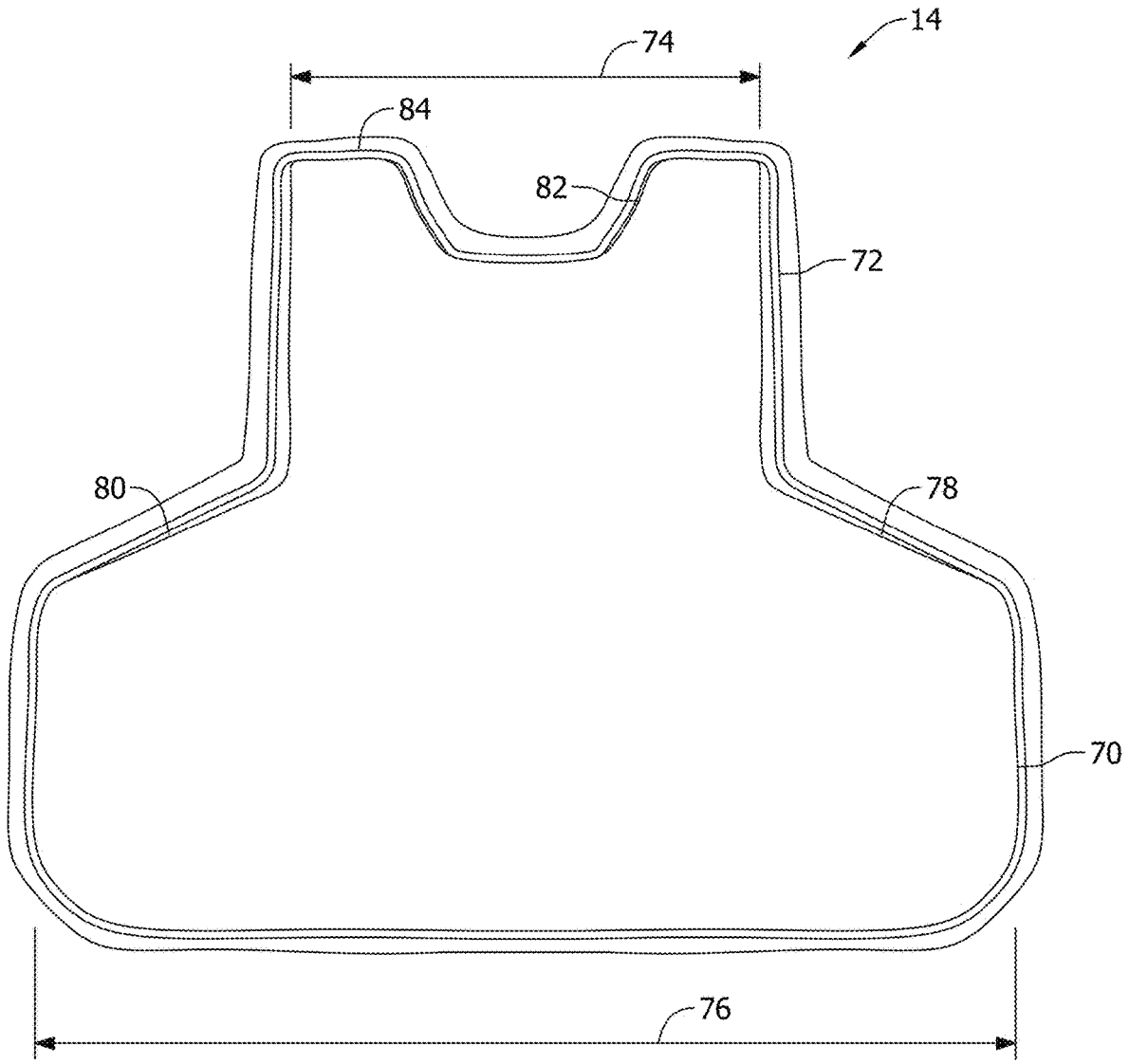
Figure 21:
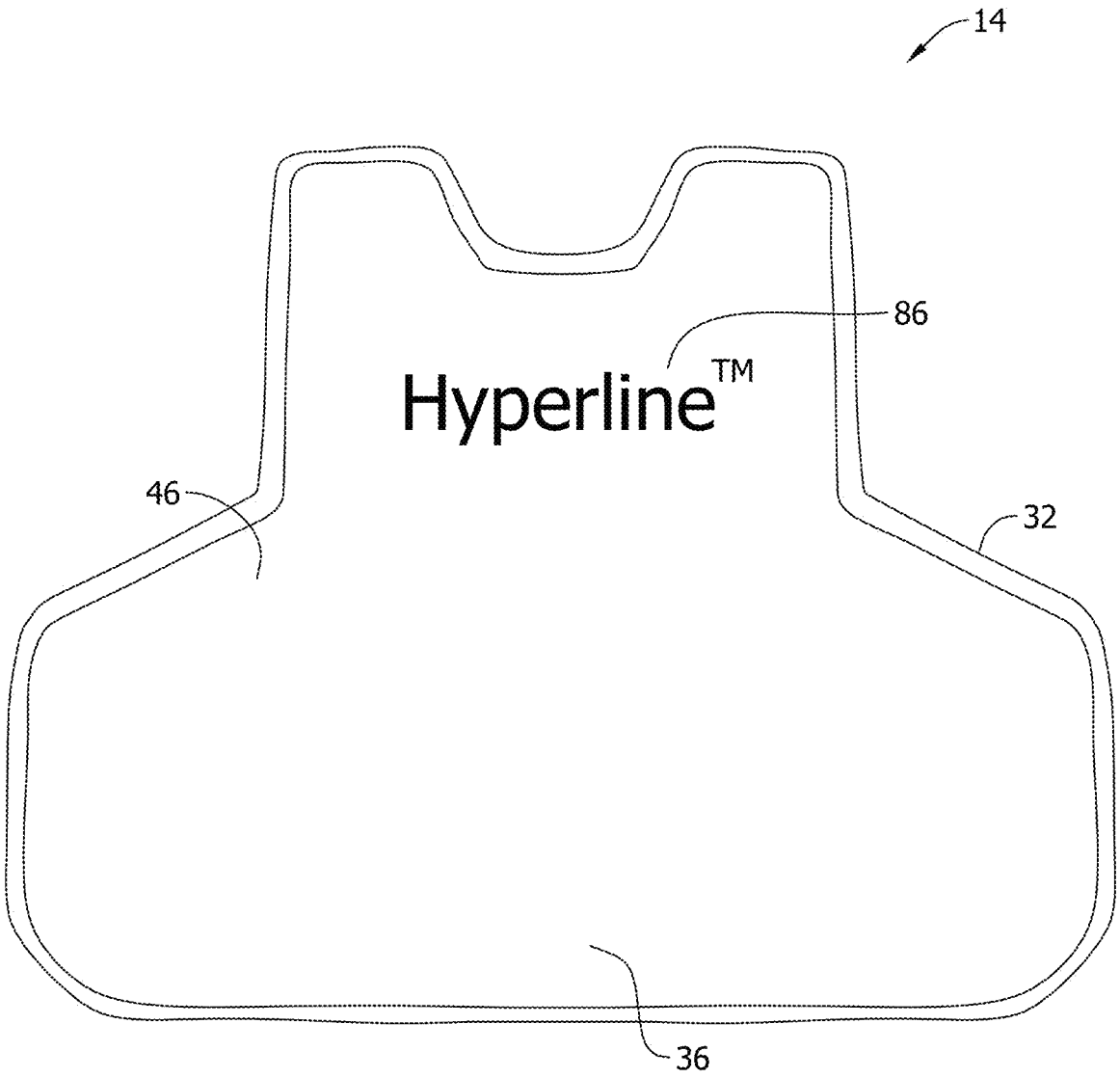
Figure 22:
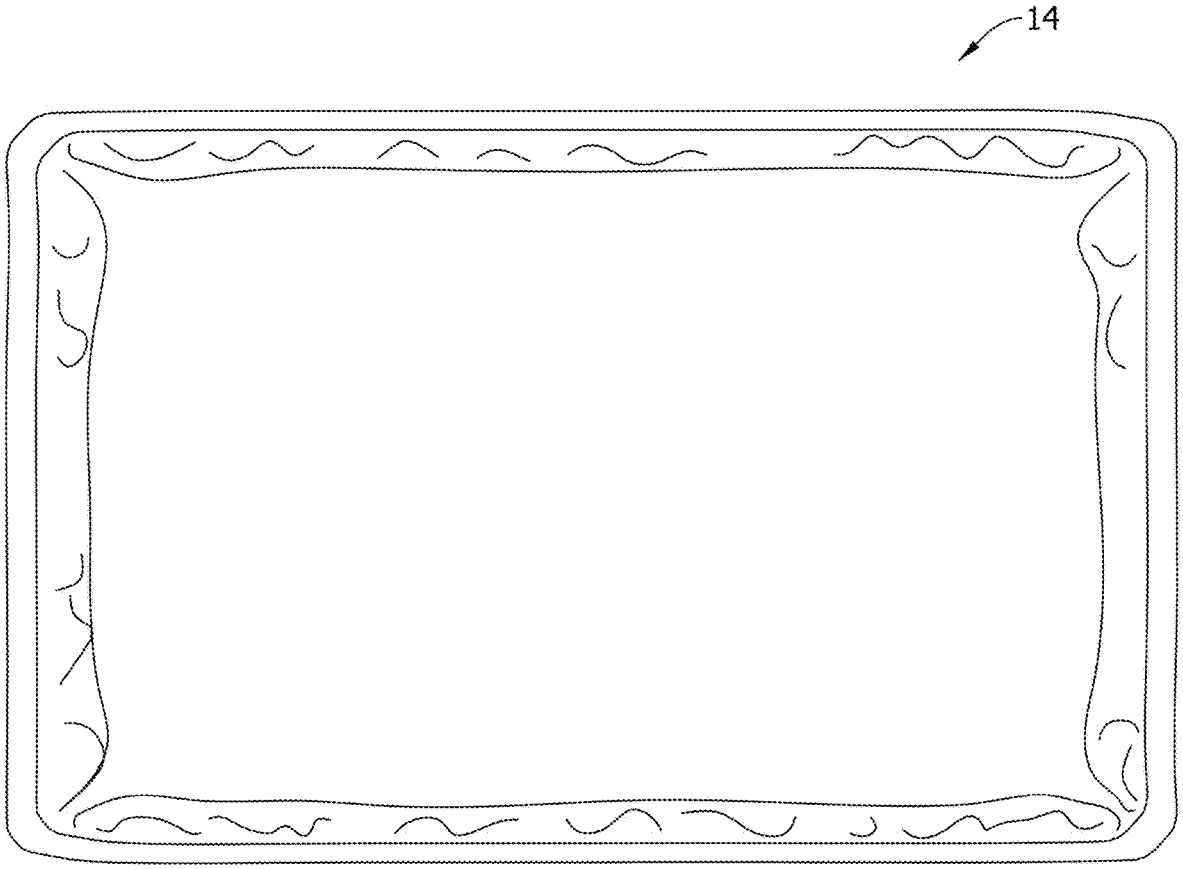

In some embodiments, as shown in FIGS. 19-21, the body armor panel 14 includes a cross-sectional shape defining a lower portion 70 and an upper portion 72 extending from the lower portion 70. The upper portion 72 has a first width 74, and the lower portion 70 has a second width 76 that is larger than the first width 74 of the upper portion 72. The body armor panel 14 also has a pair of opposing side walls 78, 80 that extend from the lower portion 70 to the upper portion 72 at opposing oblique angles. The upper portion 72 also includes an arcuate surface 82 defined along a top edge 84 of the upper portion 72. In other embodiments, as shown in FIG. 22, the body armor panel 14 may include a substantially rectangular cross-sectional shape.

Figure 28:
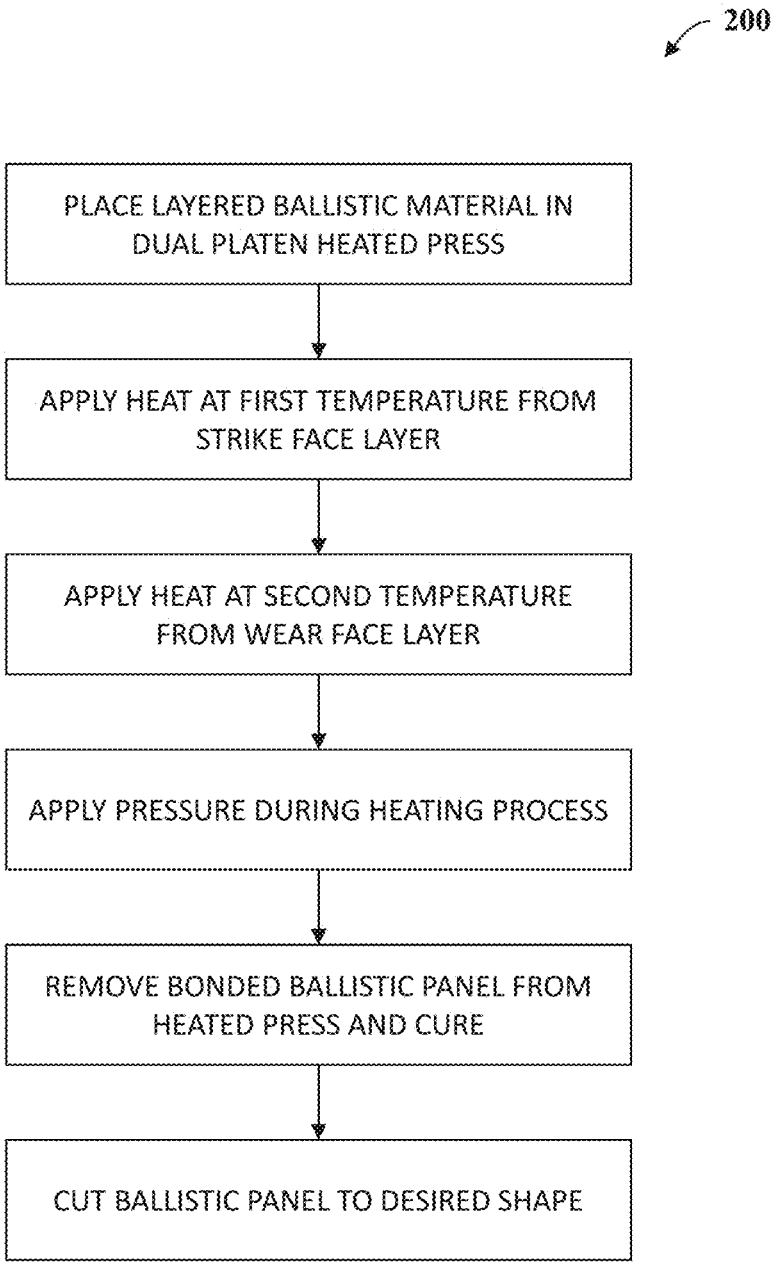
FIGS. 28 and 29 are flowcharts illustrating a method of manufacturing the body armor panel.

FIG. 28 is a flowchart illustrating a method 200 of manufacturing the body armor panel 14. The method includes a plurality of steps. Each method step may be performed independently of, or in combination with, other method steps. In the illustrated embodiment, the method 200 includes positioning the ballistic material panel assembly 36 within a dual platen heated press including placing the layered material segments 38, 40, 42, 44 within the dual platen heated press such that the first layered material segment 38 defines the strike face 46, the second layered material segment 40 is between the first layered material segment 38 and the third layered material segment 42, and the fourth layered material segment 44 is adjacent the third layered material segment 42 and defines the wear face 48.

The dual platen heated press is then operated to apply a heat process to the ballistic material panel assembly 36 including applying heat at a first temperature from the strike face 46, applying heat at a different second temperature from the wear face 48, and applying pressure to the ballistic material panel assembly 36 during the heat process. In some embodiments, the first temperature is between about 250 and 300° Fahrenheit and the second temperature is between about 150 and 225° Fahrenheit, with the applied pressure at about 80 psi.

The ballistic material panel assembly 36 is then removed from the dual platen heated press after a first predefined elapsed period of time. For example, in some embodiments, the first predefined elapsed period of time is about 1.5 minutes. The ballistic material panel assembly 36 is allowed to cool for a second elapsed period of time and then cut to a desired shaped. In some embodiments, the second predefined elapsed period of time is about 30 seconds.

In some embodiments, the Hyperline™ soft armor panel is constructed by layering ballistic material in a 0°/0° orientation in a layered material configuration from strike face to wear face including: 1 Layer—DSM Dyneema® HB50; 4 Layers—DSM Dyneema® SB117; 8 Layers—Barrday Advanced Material Solutions™ U611; and 4 Layers—Barrday Advanced Material Solutions™ FCKER1017160-01129. The layered materials are feed into a dual platen heated press that is used to apply heat at a temperature of 250-300 degrees Fahrenheit from the strike face layer. A temperature of 150-225 degrees Fahrenheit is applied from the opposite platen to the wear face layer. Pressure is applied during the heat process at no less than 80 psi. After a minimum of 1.5 minutes the press is released and the materials is removed from the machinery and is allowed to cure for a period of no less than 30 seconds. The armor packet may be consolidated in a full sheet from which shapes may be cut by using a multi ply cutter, precision rotary blade or die cutter, or, layers may be pre-cut into uniform shapes that are layered and consolidated using the above process.

The ballistic material panel assembly 36 is sealed inside an outer cover 32 including water resistant TPU material such as, for example, Brookwood™ Cover HST 30d. The TPU is sealed using a High Frequency Ultrasonic Welding Machine. In some embodiments, the body armor panel 14 includes a High Frequency Weld (HFW) seal 58 about the perimeter of the ballistic material panel assembly 36 having a width of about 0.25 inches+/−0.25 inches, with a maximum gap 60 between the ballistic panel 36 and the HFW seal 58 of about 0.25 inches+−0.2 inches, with an overcut 62 having a maximum allowable width equal to 0.5 inches. A thermal label with an adhesive backing is then applied to the wear face of the sealed ballistic panel.

Figure 29:
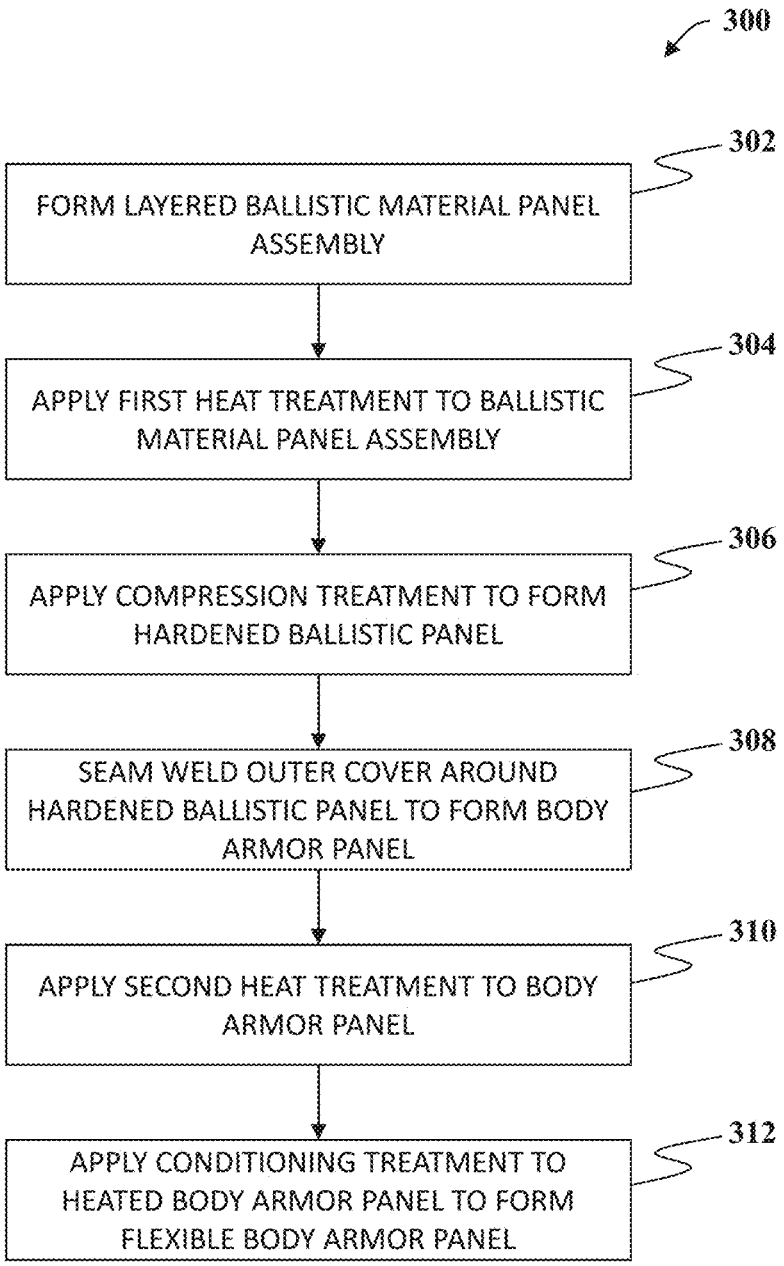
Figure 30:
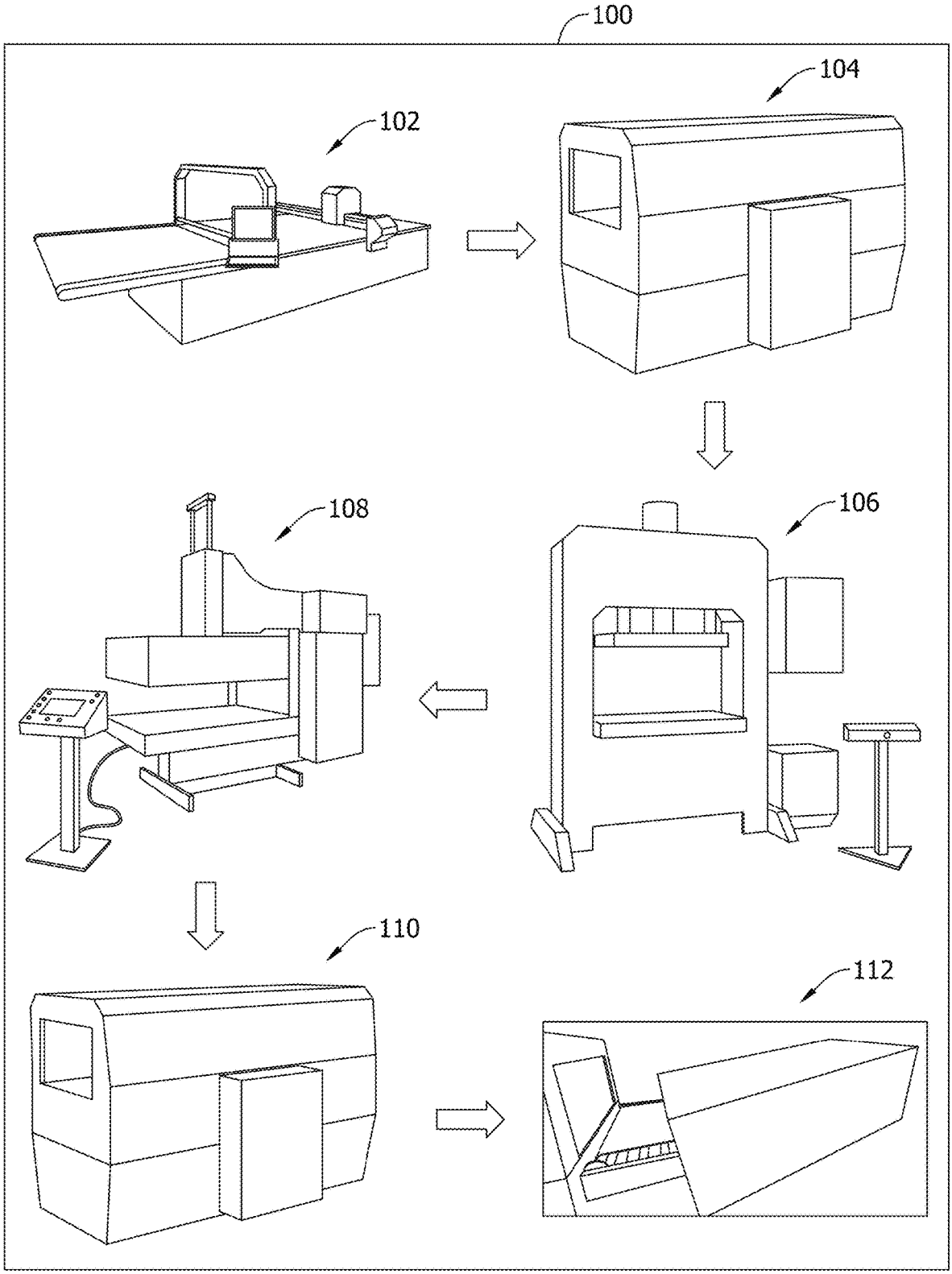
FIG. 30 is a schematic view of a system used to manufacture the body armor panel.
Figure 31:
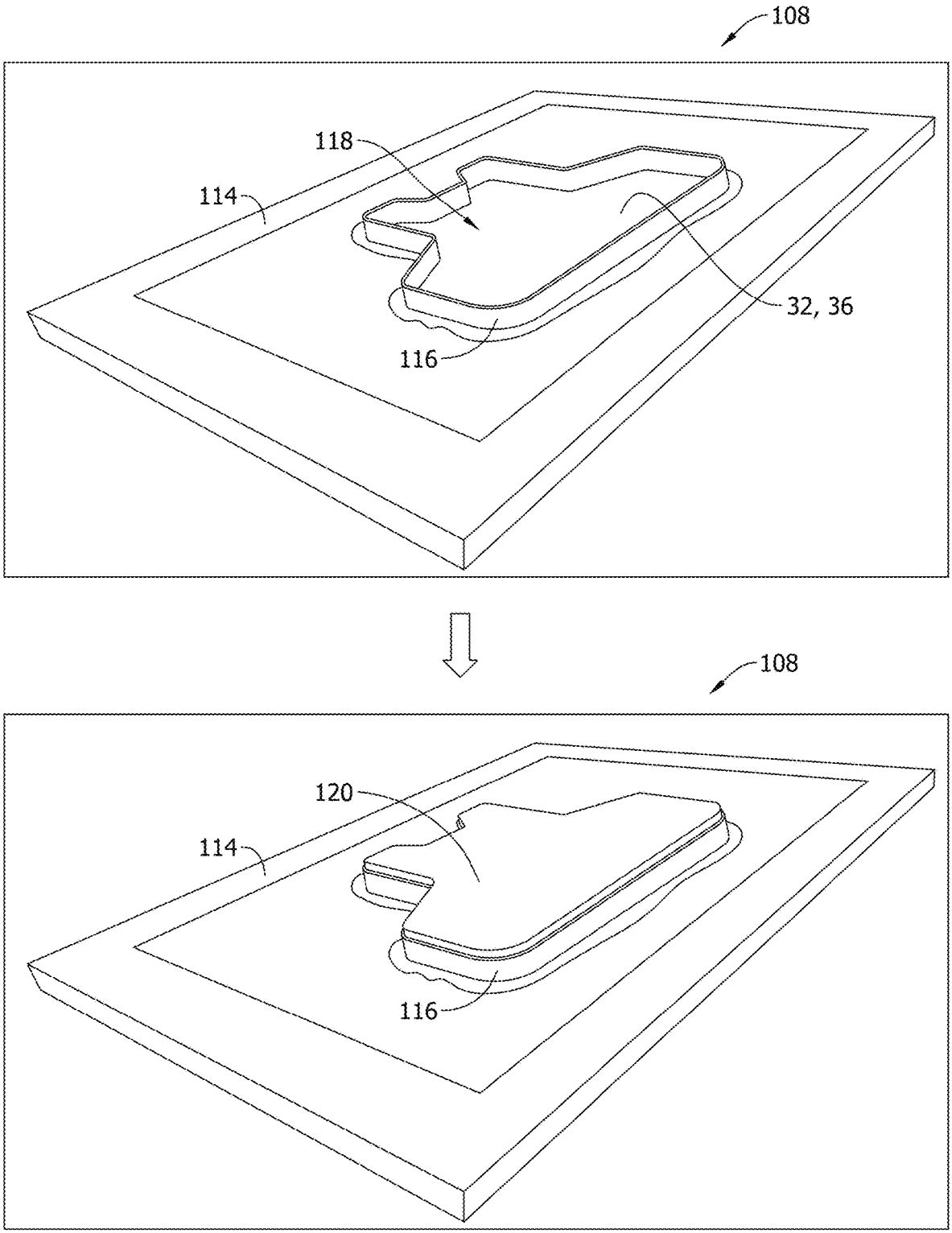
FIGS. 31-34 are schematic views of a brass mold and ballistic material panel assembly used to form the body armor panel.
Figure 32:
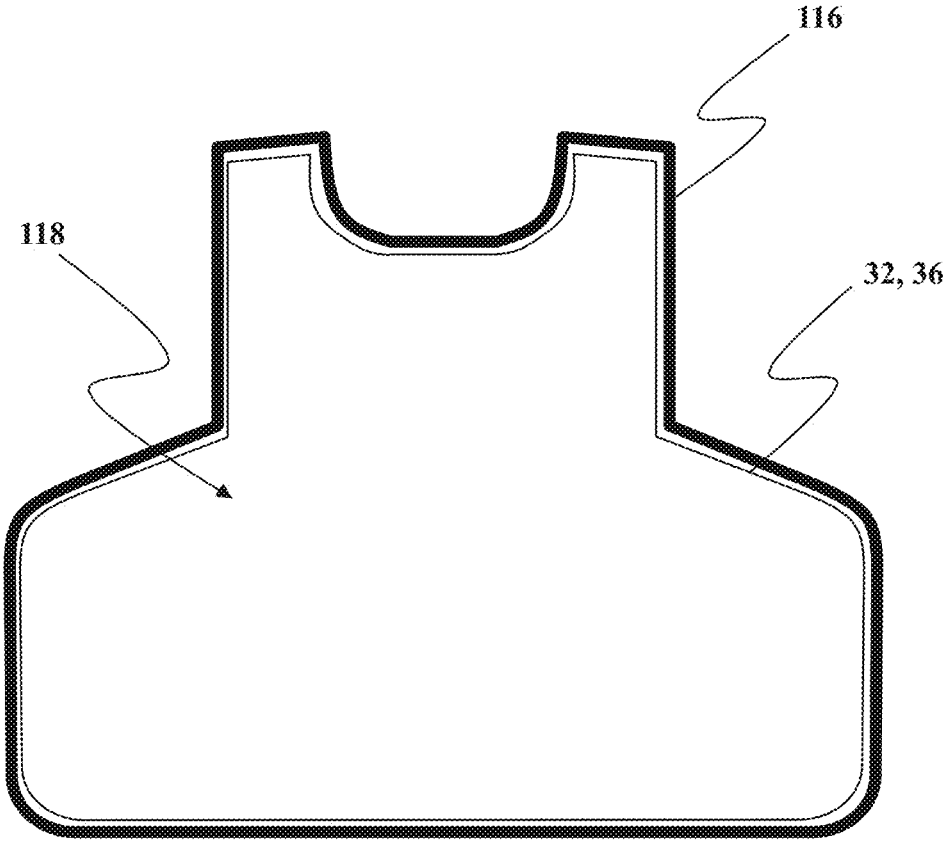
Figure 33:
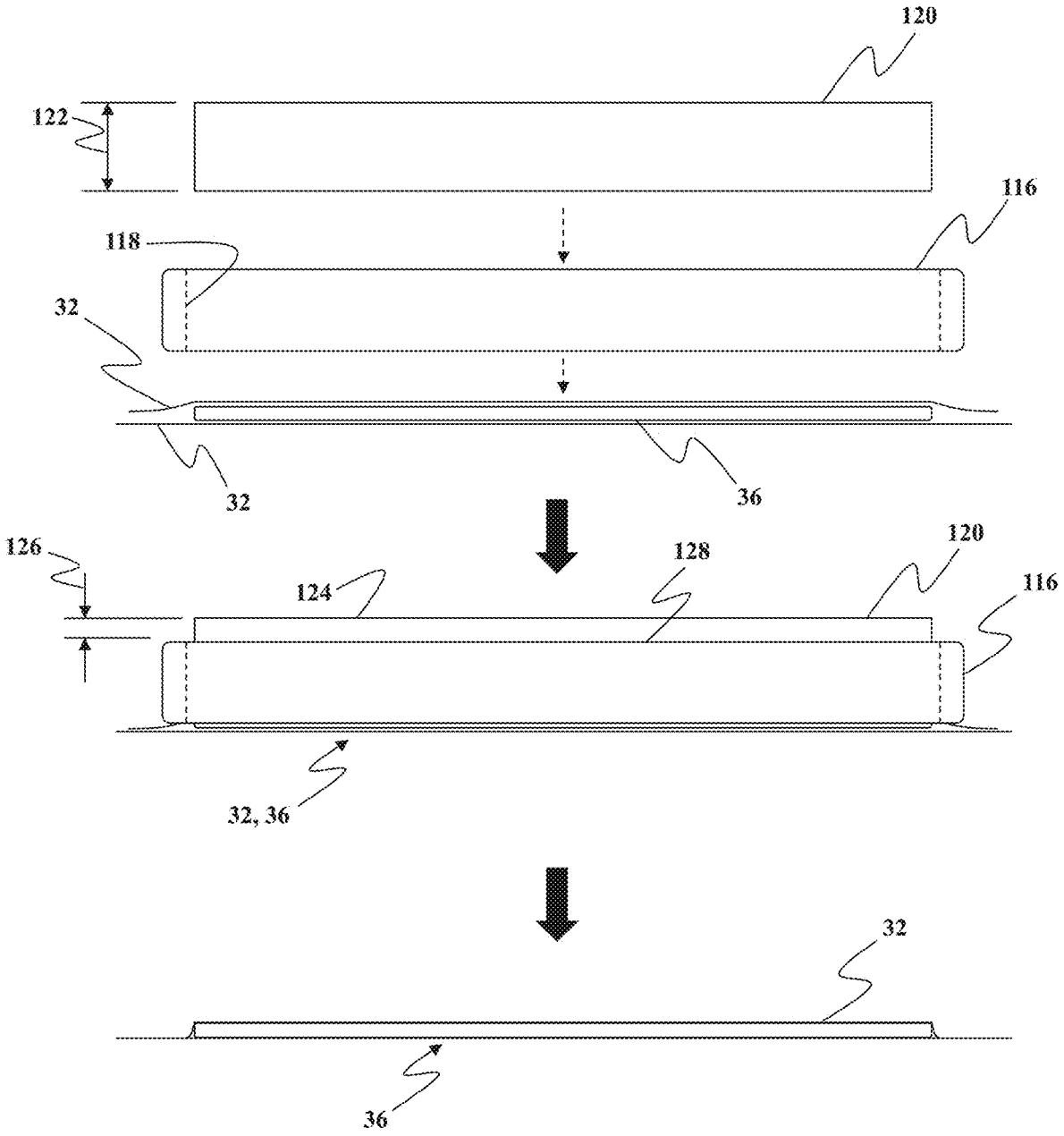

FIG. 29 is a flowchart illustrating another method 300 of manufacturing the body armor panel 14. FIG. 30 is a schematic view of a system 100 used to manufacture the body armor panel 14. In the illustrated embodiment, the system 100 includes a fabric spreading and cutting machine 102, a first industrial conveyor oven machine 104, a hydraulic press machine 106, a high frequency ultrasonic welding machine 108, a second industrial conveyor oven machine 110, and a belt press machine 112. In method step 302, the plurality of layered material segments are fed through the fabric spreading and cutting machine 102 and cut to predefined cross-sectional shapes to form a pre-cut, layered ballistic material panel assemblies 36.

In method step 304, a first heat treatment is applied to a pre-cut, layered ballistic material panel assembly 36 to increase a temperature of the ballistic material panel assembly to a predefined temperature. The first heat treatment may be applied to increase the temperature of the ballistic material panel assembly to the predefined temperature between about 150° and 190° Fahrenheit. For example, the pre-cut, layered ballistic material panel assembly 36 may be positioned within an industrial heat tunnel, i.e., the first industrial conveyor oven machine 104, for a predefined period of time to increase the temperature of the ballistic material panel assembly to the predefined temperature between about 150° and 190° Fahrenheit. In some embodiments, applying the first heat treatment includes operating the industrial heat tunnel at an internal temperature between about 300° and 350° Fahrenheit, and positioning the ballistic material panel assembly within the heat tunnel for an elapsed heating time between about 1 minute and 2 minutes. For example, the first heat treatment may include feeding the pre-cut, layered ballistic material panel assembly 36 through the first industrial conveyor oven machine 104 operated with a heated environment of about 335° F. for 1 minute and 50 seconds. In some embodiments, a reflective adhesive vinyl sticker 86 is applied onto a top layer (i.e., the strike face 46) of the ballistic material panel assembly 36 prior to the first heat treatment.

In method step 306, a compression treatment is applied to the heated ballistic material panel assembly at a predefined pressure and a predefined period of time to form a hardened ballistic material panel assembly. For example, upon completion of the first heat treatment, the heated ballistic material panel assembly is removed from the first industrial conveyor oven machine 104 and positioned onto the hydraulic press machine 106. The hydraulic press machine 106 is then operated to apply the compression treatment including applying a pressure between about 100 to 500 tons to the heated ballistic material panel assembly. The compression treatment may include, for example, applying a pressure between about 100 to 500 tons to the heated ballistic material panel assembly for a period of 30 seconds. In some embodiments, the compression treatment may include applying 200 tons of pressure to the heated ballistic material panel assembly for a period of 30 seconds to form a hardened ballistic material panel assembly.

In embodiments in which the reflective adhesive vinyl sticker 86 has been applied onto the strike face 46 of the ballistic material panel assembly 36 prior to the first heat treatment, the compression treatment embeds the reflective adhesive vinyl sticker 86 into the strike face 46 such that surface of reflective adhesive vinyl sticker 86 is substantially flush with the strike face 46 of the hardened ballistic material panel assembly.

Figure 34:
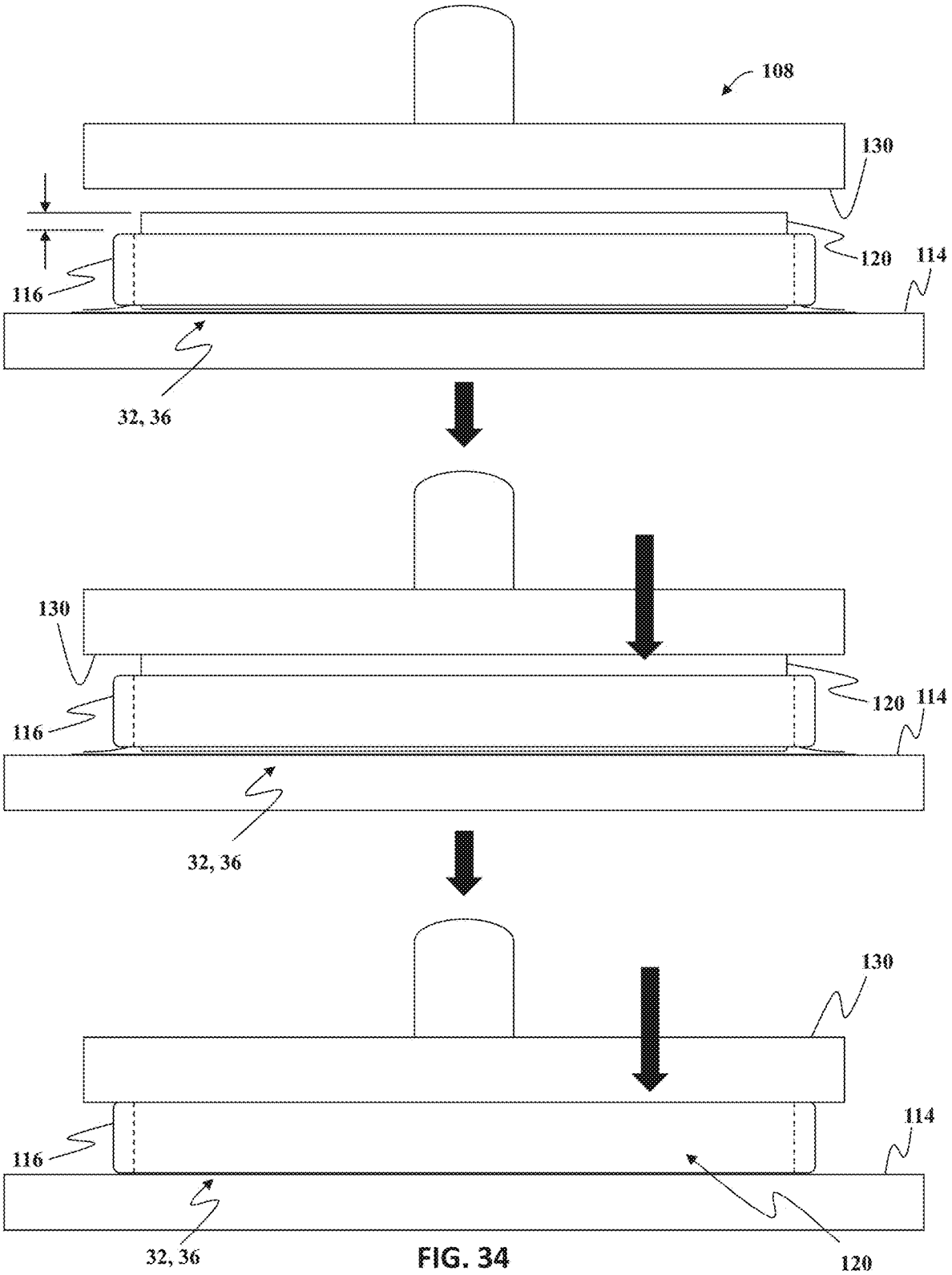

In method step 308, the hardened ballistic material panel assembly 36 is positioned within the outer cover 32 and the outer cover 32 is welded to form a perimeter seam about a perimeter of the hardened ballistic material panel assembly to seal the hardened ballistic material panel assembly within the outer cover to form a body armor panel 14. For example, as shown in FIGS. 29-34, the upon completing the compression treatment, the hardened ballistic material panel assembly 36 may be positioned between two layers of pre-cut outer cover material (e.g., Brookwood™ Cover HST 30d) having a cross-sectional shape substantially similar to the hardened ballistic material panel assembly 36, and placed on a bottom plate 114 of the high frequency ultrasonic welding machine 108. A brass mold assembly 116 having cross-sectional shape substantially similar to the hardened ballistic material panel assembly 36 is positioned over a top layer of the pre-cut outer cover material such that the hardened ballistic material panel assembly 36 is positioned within a cavity 118 defined through the brass mold assembly 116. A compressible insert 120 is then placed within the cavity 118 on top of the hardened ballistic material panel assembly 36 and outer cover 32. The compressible insert 120 includes a thickness 122 such that a top surface 124 of the compressible insert 120 is spaced a vertical distance 126 above an upper surface 128 of the brass mold assembly 116 with the compressible insert 120 contacting the outer cover 32. As shown in FIG. 34, as a top plate 130 of the high frequency ultrasonic welding machine 108 is moved to contact the brass mold assembly 116, the top plate 130 contacts the compressible insert 120 to cause the compressible insert 120 to compress and apply pressure onto the hardened ballistic material panel assembly 36 and outer cover 32 to force air trapped between the hardened ballistic material panel assembly 36 and outer cover 32 towards the perimeter of the outer cover 32 before the top plate 130 contacts the brass mold assembly 116. Once the top plate 130 is in contact with the brass mold assembly 116, the high frequency ultrasonic welding machine 108 is operated to weld a perimeter seam along the outer cover 32 via the brass mold assembly 116 to form a vacuum seal between the hardened ballistic material panel assembly 36 and the outer cover 32.

In some embodiments, the high frequency ultrasonic welding machine 108 is operated to seal the hardened ballistic material panel assembly 36 within a water resistance thermo-plastic packaging. The water resistance thermo-plastic packaging may include a semi-transparent thermo-plastic material such that the reflective adhesive vinyl sticker 86 is visible through the water resistance thermo-plastic outer cover. In some embodiments, the compressible insert 120 includes a Nomex® material positioned within the brass mold assembly 116. As the high frequency ultrasonic welding machine 108 operates the top plate 130 to lower and contact the brass mold assembly 116, the top plate 130 contacts the Nomex insert to apply pressure to the top layer of water-resistance material to remove air between top/bottom layers of material and the hardened ballistic material panel assembly 36 to facilitate eliminating air from the body armor panel 14. The high frequency ultrasonic welding machine 108 then applies high frequency radio waves to water resistance material layers through brass mold assembly to form the perimeter weld to seal the hardened ballistic material panel assembly 36 within the water resistant outer cover packaging and form an air-tight seal. The air-tight seal facilitates maintaining the shape of the assembled panel.

In another embodiment, the first heat treatment and the compression treatment are applied to only a portion of the plurality of the plurality of layered material segments 38, 40, 42, 44. For example, in some embodiments, the first heat treatment and the compression treatment are applied only to the first and second layered material segments 38, 40 to form a partially hardened ballistic material panel assembly. The partially hardened ballistic material panel assembly is then layered onto the third layered material segment 42 and/or the fourth layered material segment 44 to form the completed ballistic material panel assembly, which is then placed within the outer cover 32 and into the high frequency ultrasonic welding machine 108 to weld the perimeter seam about the completed ballistic material panel assembly.

In other embodiments, the first heat treatment and the compression treatment are applied only to the third layered material segment 42 and/or the fourth layered material segment 44 to form the partially hardened ballistic material panel assembly. The first and second layered material segments 38, 40 are then layered on top of the partially hardened ballistic material panel assembly to form the completed ballistic material panel assembly prior to welding the outer cover 32 onto the completed ballistic material panel assembly.

In method step 310, a second heat treatment is applied to the body armor panel 14 to increase a temperature of the body armor panel 14 to a second predefined temperate. For example, after the hardened ballistic material panel assembly 36 has been welded within the outer cover 32 to form the sealed body armor panel 14, the sealed body armor panel 14 is then placed into the second industrial conveyor oven machine 110 for a predefined period of time to increase the temperature of the sealed body armor panel 14 to facilitate increasing a flexibility of the sealed body armor panel 14. The second industrial conveyor oven machine 110 is operated at a lower internal temperature then the first industrial conveyor oven machine 104.

In method step 312, a conditioning treatment is then applied to the heated body armor panel 14 to increase a flexibility of a conditioned body armor panel 14. For example, after the second heat treatment is completed, the heated body armor panel 14 is fed through a belt press machine 112 that includes a pair of opposing conveyor belt systems that form roller pairs of varying heights. As the heated body armor panel 14 is moved through the roller pairs the heated body armor panel 14 is moved through various vertical positions, thereby breaking-in the heated body armor panel 14 to increase the flexibility of the finished, conditioned body armor panel 14.

Obviously, many modifications and variations of the present invention are possible in light of the above teachings. The invention may be practiced otherwise than as specifically described within the scope of the appended claims.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A personal protective vest assembly comprising:

a carrier vest including:

a front vest panel assembly adapted to overlay a chest of the wearer;

a rear vest panel assembly adapted to overlay a back of the wearer; and a plurality of attachment straps removably coupled to the front vest panel assembly and the rear vest panel assembly;

the front vest panel assembly including a front vest panel body extending between a front vest upper portion and a front vest lower portion along a vertical axis and between opposing front vest side edges along a horizontal axis;

the front vest panel body including a forward facing outer surface, an interior facing outer surface, and an inner surface defining a front vest ballistic panel pocket therein;

the forward facing outer surface including a pair of lower front vest fastening sections defined along the front vest lower portion orientated in a mirrored relationship along the vertical axis;

each lower front vest fastening section including hook & loop fabric material extending from a corresponding front vest side edge towards a center of the front vest lower portion and including an interior edge spaced a distance from the corresponding front vest side edge and having a concave arcuate shape extending from an upper end of the front vest lower portion to a bottom edge of the forward facing outer surface; and a first flexible body armor panel positioned within the front vest ballistic panel pocket and including a ballistic material panel including a plurality of layered material segments defined between a strike face and a wear face, each of the layered material segments including a different ballistic material.

2. The personal protective vest assembly of claim 1, wherein the front vest upper portion includes opposing shoulder portions defining an arcuate concave neckline, the forward facing outer surface includes a pair of opposing upper front vest fastening sections defined along the front vest upper portion and orientated in a mirrored relationship along the vertical axis, each upper front vest fastening section including hook & loop fabric material extending across a corresponding shoulder portion and including a bottom edge extending from the neckline to a corresponding front vest side edge at a downward oblique angle.

3. The personal protective vest assembly of claim 2, wherein the front vest panel assembly includes a front vest central portion having a smooth surface extending between each lower front vest fastening section and each upper front vest fastening section.

4. The personal protective vest assembly of claim 2, wherein the rear vest panel assembly includes:

a rear vest panel body extending between a rear vest upper portion and a rear vest lower portion along the vertical axis and between a first rear vest side edge and an opposing second rear vest side edge along the horizontal axis;

the rear vest panel body including a rear vest forward facing outer surface and a rear vest interior facing outer surface; and the rear vest forward facing outer surface including a lower rear vest fastening section defined along the rear vest lower portion including hook & loop fabric material extending from a top end of the rear vest lower portion to a bottom edge of the rear vest forward facing outer surface and from the first rear vest side edge to the opposing second rear vest side edge.

5. The personal protective vest assembly of claim 4, wherein the rear vest panel body includes a rear vest inner surface defining a rear vest ballistic panel pocket therein, the carrier vest includes a second flexible body armor panel positioned within the rear vest ballistic panel pocket.

6. The personal protective vest assembly of claim 4, wherein the rear vest upper portion includes opposing rear vest shoulder portions defining an arcuate concave rear vest neckline, the rear vest forward facing outer surface includes a pair of opposing upper rear vest fastening sections defined along the rear vest upper portion and orientated in a mirrored relationship along the vertical axis, each upper rear vest fastening section including hook & loop fabric material extending across a corresponding rear vest shoulder portion and including a bottom edge extending from the rear vest neckline to a corresponding rear vest side edge at a downward oblique angle.

7. The personal protective vest assembly of claim 6, wherein the rear vest panel assembly includes a rear vest central portion having a smooth surface extending between the lower rear vest fastening section and each of the upper rear vest fastening sections.

8. The personal protective vest assembly of claim 6, wherein the plurality of attachment straps includes a pair of upper attachment straps removably coupled to a corresponding upper front vest fastening section and a corresponding upper rear vest fastening section.

9. The personal protective vest assembly of claim 8, wherein the plurality of attachment straps includes two pairs of side attachment straps, each pair of side attachment straps removably coupled to the lower rear vest fastening section and a corresponding lower front vest fastening section.

10. The personal protective vest assembly of claim 9, wherein each pair of side attachment straps includes an upper side attachment strap and a lower side attachment strap, the lower side attachment strap positioned closer to a bottom of the carrier vest than the upper side attachment strap and including a length that is longer than a length of the upper side attachment strap.

11. The personal protective vest assembly of claim 1, wherein each attachment strap includes a pair of opposing fastening tabs each including hook & loop fabric material defined along an outer surface and a flexible section including an elastic material extending between the opposing fastening tabs.

12. A carrier vest comprising:

a front vest panel assembly adapted to overlay a chest of the wearer;

a rear vest panel assembly adapted to overlay a back of the wearer; and a plurality of attachment straps removably coupled to the front vest panel assembly and the rear vest panel assembly;

the front vest panel assembly including a front vest panel body extending between a front vest upper portion and a front vest lower portion along a vertical axis and between opposing front vest side edges along a horizontal axis;

the front vest panel body including a forward facing outer surface and an interior facing outer surface;

the forward facing outer surface including a pair of lower front vest fastening sections defined along the front vest lower portion orientated in a mirrored relationship along the vertical axis;

each lower front vest fastening section including hook & loop fabric material extending from a corresponding front vest side edge towards a center of the front vest lower portion and including an interior edge spaced a distance from the corresponding front vest side edge and having a concave arcuate shape extending from an upper end of the front vest lower portion to a bottom edge of the forward facing outer surface.

13. The carrier vest of claim 12, wherein the front vest upper portion includes opposing shoulder portions defining an arcuate concave neckline, the forward facing outer surface includes a pair of opposing upper front vest fastening sections defined along the front vest upper portion and orientated in a mirrored relationship along the vertical axis, each upper front vest fastening section including hook & loop fabric material extending across a corresponding shoulder portion and including a bottom edge extending from the neckline to a corresponding front vest side edge at a downward oblique angle.

14. The carrier vest of claim 13, wherein the front vest panel assembly includes a front vest central portion having a smooth surface extending between each lower front vest fastening section and each upper front vest fastening section.

15. The carrier vest of claim 13, wherein the rear vest panel assembly includes:

a rear vest panel body extending between a rear vest upper portion and a rear vest lower portion along the vertical axis and between a first rear vest side edge and an opposing second rear vest side edge along the horizontal axis;

the rear vest panel body including a rear vest forward facing outer surface and a rear vest interior facing outer surface; and the rear vest forward facing outer surface including a lower rear vest fastening section defined along the rear vest lower portion including hook & loop fabric material extending from a top end of the rear vest lower portion to a bottom edge of the rear vest forward facing outer surface and from the first rear vest side edge to the opposing second rear vest side edge.

16. The carrier vest of claim 15, wherein the rear vest upper portion includes opposing rear vest shoulder portions defining an arcuate concave rear vest neckline, the rear vest forward facing outer surface includes a pair of opposing upper rear vest fastening sections defined along the rear vest upper portion and orientated in a mirrored relationship along the vertical axis, each upper rear vest fastening section including hook & loop fabric material extending across a corresponding rear vest shoulder portion and including a bottom edge extending from the rear vest neckline to a corresponding rear vest side edge at a downward oblique angle.

17. The carrier vest of claim 16, wherein the rear vest panel assembly includes a rear vest central portion having a smooth surface extending between the lower rear vest fastening section and each of the upper rear vest fastening sections.

18. The carrier vest of claim 16, wherein the plurality of attachment straps includes a pair of upper attachment straps removably coupled to a corresponding upper front vest fastening section and a corresponding upper rear vest fastening section.

19. The carrier vest of claim 18, wherein the plurality of attachment straps includes two pairs of side attachment straps, each pair of side attachment straps removably coupled to the lower rear vest fastening section and a corresponding lower front vest fastening section.

20. The carrier vest of claim 19, wherein each pair of side attachment straps includes an upper side attachment strap and a lower side attachment strap, the lower side attachment strap positioned closer to a bottom of the carrier vest than the upper side attachment strap and including a length that is longer than a length of the upper side attachment strap.

* * * * *